US007641322B2

(12) United States Patent
Sugahara

(10) Patent No.: US 7,641,322 B2
(45) Date of Patent: Jan. 5, 2010

(54) PRINTING APPARATUS

(75) Inventor: Hiroto Sugahara, Ama-gun (JP)

(73) Assignee: Brother Kogyo Kabushiki Kaisha (JP)

( * ) Notice: Subject to any disclaimer, the term of this patent is extended or adjusted under 35 U.S.C. 154(b) by 408 days.

(21) Appl. No.: 11/167,292

(22) Filed: Jun. 28, 2005

(65) Prior Publication Data

US 2006/0001705 A1 Jan. 5, 2006

(30) Foreign Application Priority Data

Jun. 30, 2004 (JP) ..... 2004-193949

(51) Int. Cl.
*B41J 2/045* (2006.01)

(52) U.S. Cl. ..... 347/70

(58) Field of Classification Search ..... 347/55, 347/69, 70, 112, 56–57, 44–45, 64
See application file for complete search history.

(56) References Cited

U.S. PATENT DOCUMENTS

| | | | | |
|---|---|---|---|---|
| 4,162,502 | A | 7/1979 | Cielo et al. | |
| 4,166,277 | A | 8/1979 | Cielo et al. | |
| 4,396,925 | A | 8/1983 | Kohashi | |
| 5,751,314 | A * | 5/1998 | Takemura et al. | 347/55 |
| 6,336,697 | B1 | 1/2002 | Fukushima | |
| 6,545,815 | B2 | 4/2003 | Kroupenkine et al. | |
| 7,264,337 | B2 * | 9/2007 | Lee et al. | 347/55 |
| 2003/0048541 | A1 | 3/2003 | Kroupenkine et al. | |
| 2003/0156167 | A1 | 8/2003 | Sakaida et al. | |
| 2004/0218018 | A1 | 11/2004 | Sakaida et al. | |

FOREIGN PATENT DOCUMENTS

| | | | |
|---|---|---|---|
| EP | 0963842 | | 12/1999 |
| JP | 06262770 | A * | 9/1994 |
| JP | 2003-177219 | | 6/2003 |
| JP | 2004-160967 | | 6/2004 |
| WO | WO 03/070381 | | 8/2003 |

OTHER PUBLICATIONS

Cho et al.; Creating, Transporting, Cutting, and Merging Liquid Droplets by Electrowing-Based Actuation for Digital Microfluidic Circuits; Journal of Microelectromechanical Systems, vol. 12, No. 1, p. 70, dated Feb. 2003.

* cited by examiner

*Primary Examiner*—Matthew Luu
*Assistant Examiner*—Lisa M Solomon
(74) *Attorney, Agent, or Firm*—Banner & Witcoff, Ltd.

(57) ABSTRACT

A printing apparatus includes: a common liquid chamber that stores electrically conductive liquid; plural liquid transfer paths extending from the common liquid chamber to a print medium; a liquid deriving and transferring unit that selectively derives liquid from the common liquid chamber to the plural liquid transfer paths and transfers liquid to the print medium; and a liquid transfer controlling unit that controls the liquid deriving and transferring unit. The liquid deriving and transferring unit has: plural electrodes respectively provided along the plural liquid transfer paths; a voltage applying unit that selectively applies a voltage to the plural electrodes; and an insulating film provided on surfaces of the plural electrodes and adapted to reduce, when the voltage applying unit applies a voltage to one of the electrodes, liquid repellency of a part corresponding to the one of the electrodes.

15 Claims, 20 Drawing Sheets

PRINTING APPARATUS

BACKGROUND OF THE INVENTION

1. Field of the Invention

The present invention relates to a printing apparatus for printing by transferring liquid to a print medium.

2. Description of the Related Art

Printing apparatuses adapted to print a print medium such as a sheet of paper, which have been hitherto known, include, for example, inkjet heads adapted to eject ink onto a sheet of paper or the like. There have been various types of the inkjet heads. For instance, one such inkjet head includes a passage unit that has plural individual ink passages including pressure chambers each communicated with a nozzle, and also includes plural piezoelectric actuator units each adapted to apply pressure to ink in each of the corresponding pressure chambers (see, for example, JP-A-2004-160967 (FIG. 1)). Incidentally, each of the piezoelectric actuator units has plural individual electrodes respectively corresponding to the plural pressure chambers, and also has common electrodes respectively facing the plural individual electrodes, piezoelectric layers, each of which is sandwiched between the corresponding individual electrode and the corresponding common electrode and is made of lead zirconate titanate (PZT). Further, when a drive voltage is supplied to a predetermined one of the individual electrodes, an electric field acts upon the piezoelectric layer sandwiched between the predetermined individual electrode and the corresponding common electrode, so that the piezoelectric layer is partly deformed. With this deformation of the piezoelectric layer, pressure is applied to ink in the corresponding pressure chamber. Thus, ink is ejected from the nozzle communicated with this pressure chamber.

SUMMARY OF THE INVENTION

However, the aforementioned inkjet head has the passage unit, in which the individual ink passages including the nozzles and the pressure chambers are formed, and also has the actuator units, each of which has the plural individual electrodes and the plural common electrodes and the piezoelectric layers, so that the structure thereof is complex. Thus, the manufacturing cost of the inkjet head is high. Also, in a case where the necessity for providing many nozzles in the passage unit arises so as to realize high image quality printing and high speed printing, it is difficult to densely form the plural individual ink passages including the plural nozzles and the plural pressure chambers in the passage unit, to arrange the plural individual electrodes at a high density, and to miniaturize the inkjet head.

The present invention provides a printing apparatus enabled to reliably transfer liquid to a print medium by a simple configuration.

According to an aspect of the invention, there is provided A printing apparatus including: a common liquid chamber that stores electrically conductive liquid and has a deriving port; a plurality of liquid transfer paths extending from the common liquid chamber to a print medium; a liquid deriving unit that selectively derives liquid from the common liquid chamber to the plurality of liquid transfer paths, the liquid deriving unit having: a plurality of first electrodes, respectively provided near to the deriving port, corresponding to the plurality of liquid transfer paths; a first voltage applying unit that selectively applies a voltage to the plurality of first electrodes; and a first insulating film provided on surfaces of the plurality of first electrodes and adapted to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes; a liquid transfer unit that transfers the liquid, which is derived to the liquid transfer path, to the print medium; and a liquid transfer controlling unit that controls the liquid deriving unit and the liquid transfer unit.

In this printing apparatus, electrically conductive liquid is derived by the liquid deriving unit to the predetermined liquid transfer path from the common liquid chamber. The derived liquid is transferred by the liquid transfer unit to the print medium along the liquid transfer path. Incidentally, the liquid deriving unit has plural first electrodes, which are respectively provided near to the deriving port of the common liquid chamber, corresponding to the plural liquid transfer paths, the first voltage applying unit for selectively applying a voltage to the plural first electrodes, and the first insulating film provided on surfaces of the plural first electrodes and adapted to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes. Further, when a voltage is applied by the first voltage applying unit to the first electrode provided on the predetermined liquid transfer path, an angle of liquid on the surface of a part of the first insulating film, which corresponds to this first electrode, is reduced. Thus, as compared with a state in which no voltage is applied to the first electrode, the liquid repellency of the first insulating film is lowered (that is, the electrowetting phenomenon). Consequently, the liquid is moved to the surface of the first insulating film from the common liquid chamber. Therefore, liquid can easily be derived from the common liquid chamber to the predetermined liquid transfer path. Also, the configuration of the liquid deriving means is simplified. Thus, the manufacturing cost of the printing apparatus can be reduced.

Also, this printing apparatus operates quietly with reduced power consumption. Further, high density and high resolution printing can be performed by this printing apparatus.

BRIEF DESCRIPTION OF THE DRAWINGS

The present invention may be more readily described with reference to the accompanying drawings:

FIGS. 6A to 6D are explanatory views illustrating an ink transfer process performed on an ink transfer path in which FIG. 6A illustrates a state in which no the ink is derived to the ink transfer path, FIG. 6B illustrates a state in which the ink is being derived thereto, FIG. 6C illustrates a state in which the ink is being transferred, and FIG. 6D illustrates a state presented just before the transfer of the ink is finished;

FIGS. 13A and 13B are explanatory views illustrating a process of transferring small droplets of ink on an ink transfer path in the second modification in which FIG. 13A illustrates a state in which the ink is being derived thereto, and FIG. 13B illustrates a state in which the ink is being transferred;

FIGS. 14A and 14B are explanatory views illustrating a process of transferring medium droplets of ink on the ink transfer path in the second modification in which FIG. 14A illustrates a state in which the ink is being derived thereto, and FIG. 14B illustrates a state in which the ink is being transferred;

FIGS. 15A and 15B are explanatory views illustrating a process of transferring large droplets of ink on the ink transfer path in the second modification in which FIG. 15A illustrates a state in which the ink is being derived thereto, and FIG. 15B illustrates a state in which the ink is being transferred;

FIGS. 18A to 18C are explanatory views illustrating an ink transfer process performed on an ink transfer path in which FIG. 18A illustrates a state in which the ink is being derived to the ink transfer path, FIG. 18B illustrates a state presented just before the ink is divided, and FIG. 18C illustrates a state presented just after the ink is divided;

DETAILED DESCRIPTION OF THE PREFERRED EMBODIMENTS

An embodiment of the invention is described hereinbelow with reference to FIGS. 1 to 6D. This embodiment is an application of the invention to a printing apparatus for printing by transferring ink to a sheet of recording paper.

Figure 1:
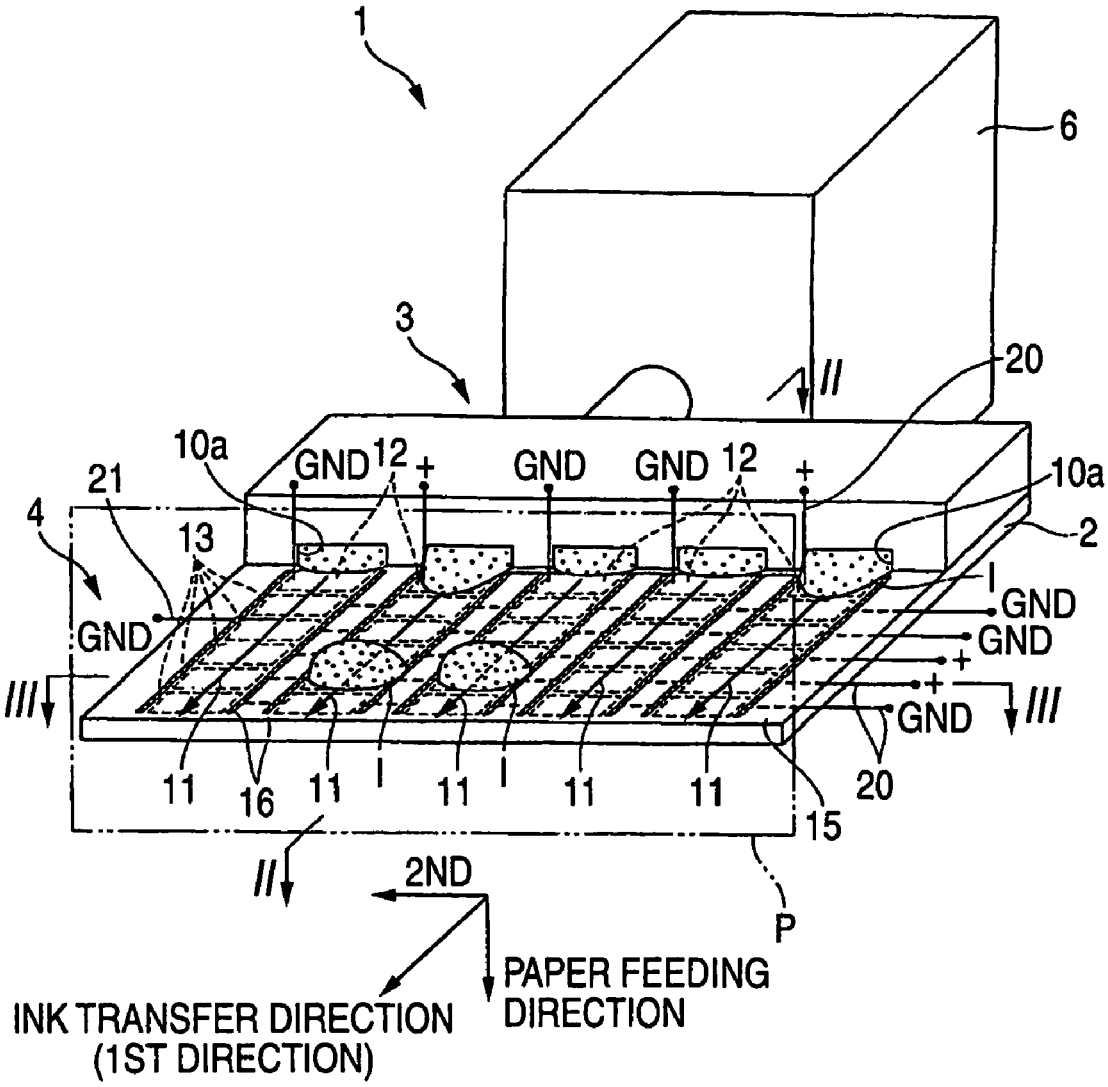
FIG. 1 is a schematic perspective view illustrating a printing apparatus according to an embodiment of the invention.

As shown in FIG. 1, a printing apparatus 1 has a substrate 2 made of an insulating material, an ink supply portion 3 supplied with ink from an ink cartridge 6, an ink transfer portion 4 for transferring ink, which is supplied to the ink supply portion 3, to recording paper P (that is, a print medium), and a control unit 5 (see FIG. 4) for controlling the entire print apparatus 1.

Figure 2:
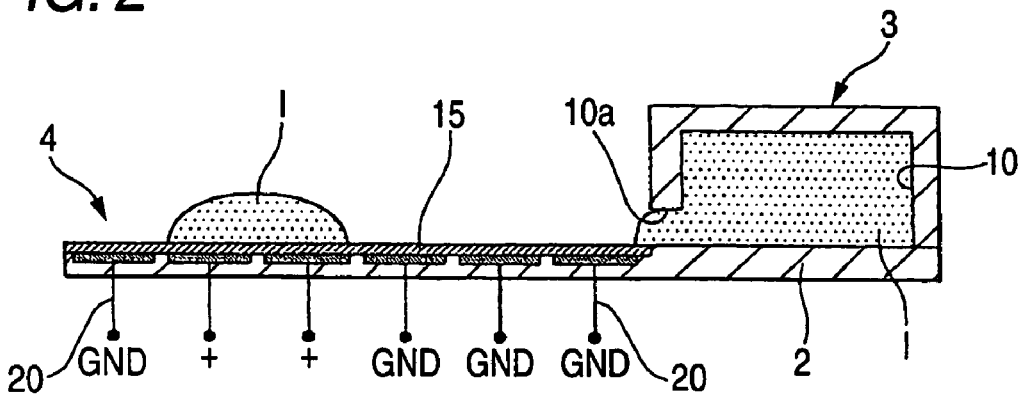
FIG. 2 is a cross-sectional view taken along line II-II shown in FIG. 1.

The ink supply portion 3 is provided at an end portion of the substrate 2. As shown in FIG. 2, a common ink chamber 110 (corresponding to the common liquid chamber) is formed in this ink supply portion 3. Further, this common ink chamber 10 is communicated with an ink cartridge 6, and is configured so that ink flows into the common ink chamber 10 from the ink cartridge 6. Incidentally, ink supplied to the printing apparatus 1 from the ink cartridge 6 has electrical conductivity. Additionally, the common ink chamber 10 is opened to the ink transfer portion 4 at five deriving ports 10*a*.

Next, the ink transfer portion 4 is described hereinbelow. This ink transfer portion 4 has five ink transfer paths 11 (corresponding to the liquid transfer paths) extending from the common ink chamber 10 of the ink supply portion 3 to recording paper P, a deriving electrode 12 (functioning as a first electrode) provided adjacent to the deriving port of the common ink chamber 10 on each of the ink transfer paths 11, five transfer electrodes 13 (functioning as second electrodes) arranged from the deriving electrode 12 along each of the ink transfer paths 11, a driver IC 14 (functioning as a first voltage applying unit and a second voltage applying unit (see FIG. 4)), an insulating film 15 (functioning as a first insulating film and a second insulating film) provided over all the deriving electrodes 12 and the transfer electrodes 13, and plural common electrodes 16 (functioning as third electrodes) respectively extending along the ink transfer paths 11 on the insulating film 15.

As shown in FIG. 1, the five ink transfer paths 11 extend in a direction indicated on paper of this figure as being directed to a near side (that is, extend in a first direction) from the deriving ports of the common ink chamber 10 on the surface of the substrate 2, respectively. Incidentally, the recording paper P is adapted to be fed downwardly, as viewed in FIG. 1, by a paper feed mechanism (not shown) at a place indicated as being nearer than an end portion of each of the ink transfer paths 11, which is indicated on paper of this figure as being placed at the near side.

The deriving electrode 12 placed adjacent to each of the deriving ports 10*a* of the common ink chamber 10 is used for driving ink to the ink transfer path 11 from the common ink chamber 10. On the other hand, the transfer electrodes 13 arranged along each of the ink transfer paths 11 from the deriving electrode 12 are used for transferring ink, which is derived by the corresponding deriving electrode 12 to the corresponding ink transfer path 11, to recording paper P along the corresponding ink transfer path 11. The deriving electrodes 12 and the five transfer electrodes 13 are arranged on the surface of the substrate 2 along the corresponding ink transfer path 11. The deriving electrodes 12 and the transfer electrodes 13 have the same rectangular planar shape and are equal in surface area to one another.

Further, as shown in FIG. 1, the five deriving electrodes 12, which are respectively disposed on the five ink transfer paths 11, and the five transfer electrodes 13 disposed in the same order of arrangement from each of these driving electrodes 12 are arranged in a second direction perpendicular to the first direction, in which the ink transfer paths 11 extend, on the substrate 2. That is, the five deriving electrodes 12 and the twenty five transfer electrodes 13, thus, thirty electrodes in total are arranged in the first direction and in the second direction on the surface of the substrate 2 and are disposed in a matrix form. Thus, the deriving electrodes 12 and the transfer electrodes 13 can densely be disposed on the surface of the substrate 2 to thereby miniaturize the printing apparatus 1. In this embodiment, each of the deriving electrodes 12 and the transfer electrodes 13 is shaped like a rectangular having a size of 16 μm×28 μm. Further, the deriving electrodes 12 and the transfer electrodes 13 are arranged at intervals of about 4 μm in the direction of each of the ink transfer paths 11 (that is, in the first direction), and are disposed at intervals of about 14 μm in the second direction.

Incidentally, the substrate 2 is formed of an insulating material, such as a glass material or a silicon material whose surface is oxidized. Thus, the five deriving electrodes 12 and the twenty five transfer electrodes 13 disposed on the surface of the substrate 2 are insulated from one another by this insulating substrate 2. Additionally, the deriving electrodes 12 and the transfer electrodes 13 are disposed on the same plane. Thus, the deriving electrodes 12 and the transfer electrodes 13 can be formed at one time on the surface of the substrate 2 in a manufacturing process. Consequently, the formation of these electrodes 12 and 13 is facilitated. Incidentally, the pattern of the deriving electrodes 12 and the transfer electrodes 13 can be formed at one time by, for instance, screen-printing. Alternatively, the electrode pattern may be formed by first applying a resist onto a part on which no electrodes are formed, and by subsequently forming a conducting film on the resist through an evaporation process or a sputtering process, and by thereafter removing the resist. Alternatively, the electrode pattern may be formed by first forming a conducting layer over the entire surface of the substrate 2 through an evaporation process or a sputtering process and by then using laser to thereby partly remove the conducting layer.

Each of the deriving electrodes 12 and the transfer electrodes 13 is connected to the driver IC 14 through wiring portions 20. Further, the driver IC 14 selectively applies voltages to the deriving electrodes 12 and the transfer electrodes 13 according to a signal outputted from the ink transfer control portion 30 (see FIG. 4) of the control unit 5. Incidentally, in FIGS. 1 to 3, reference character "+" shown at each of contact parts of the wiring portions 20 indicates a state in which a voltage is applied to the corresponding deriving electrode 12 or the corresponding transfer electrode 13. Reference character "GND" shown thereat indicates a state in which no voltage is applied thereto (that is, a state in which the corresponding deriving electrode 12 or the corresponding transfer electrode 13 is at a ground potential level). Meanwhile, the five wiring portions 20 are connected to the five deriving electrodes 12, respectively. As will be described later, the apparatus is adapted so that ink is derived only to the ink transfer path provided with the deriving electrode 12 to which a voltage is applied. On the other hand, among the transfer electrodes 13 arranged in the second direction, the transfer electrodes 13 having the same arrangement number counted from the corresponding deriving electrode 12 are electrically connected to each other. The single wiring portion 20 is connected to the electrically connected five transfer electrodes. Therefore, a voltage can be applied by the driver IC 14 to the electrically connected five transfer electrodes 13 through the one contact part and the one wiring portion 20. Consequently, the number of the wiring portions 20 and that of the contact parts can be reduced.

The insulating film 15 is continuously formed over the surfaces of the deriving electrodes 12 and the transfer electrodes 13. This insulating film 15 can be formed by coating the surface of each of the deriving electrodes 12 and the transfer electrodes 13 with a fluorinated resin by, for example, a spin coat method. Further, the thickness of this insulating film 15 is about 0.1 μm. Incidentally, in this embodiment, the insulating film 15 is formed not only on the surfaces of the electrodes 12 and 13 but the entire surface of the substrate 2. Additionally, a part of the insulating film 15, which is formed on the surface of each of the deriving electrodes 12, functions as the first insulating film. A part of the insulating film 15, which is formed on the surface of each of the transfer electrodes 13, functions as the second insulating film.

Figure 3:
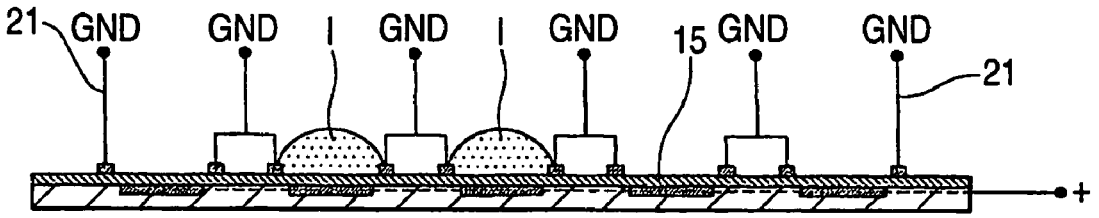
FIG. 3 is a cross-sectional view taken along line III-III shown in FIG. 1.

As shown in FIGS. 1 to 3, the plural common electrodes 16 are formed on both sides of a column, on which the deriving electrode 12 and the transfer electrodes 13 are provided, along each of the plural ink transfer paths 11. Thus, the plural common electrodes 16 can be formed at one time on the insulating film 15. Incidentally, the plural common electrodes 16 can be formed by a screen-printing method, a sputtering method, or an evaporation method, similarly to the aforementioned deriving electrodes 12 and the aforementioned transfer electrodes 13. Further, the plural common electrodes 16 are connected to the driver IC 14 through the wiring portions 21 and are held at a ground potential level. Additionally, in a state in which ink is present on the ink transfer path 11, the ink having conductivity, which is present on the surface of the insulating film 15, is in contact with the common electrodes 16 provided on both sides of a column, on which the deriving electrode 12 and the transfer electrodes 13 are provided, along each of the plural ink transfer paths 11. Thus, this ink is held at a ground potential level.

Further, when the driver IC 14 selectively applies electric potential to the deriving electrode 12 or the transfer electrode 13, a difference in the electrical potential is caused between the deriving electrode 12 or the transfer electrode 13, to which the voltage is applied, and ink I that is insulated by the insulating film 15 from the deriving electrode 12 or from the transfer electrode 13 and that is held at a ground potential level. An angle of contact of the ink I is reduced. The liquid repellency of the insulating film 15 is lowered, as compared with that in a state in which no voltage is applied to the electrodes 12 and 13 (that is, an electrowetting phenomenon). Moreover, when a part of the droplet of the ink I is in contact with a high-liquid-repellency area and the remaining part of the droplet thereof is in contact with a low-liquid-repellency area, the ink I moves in such a way as to be placed only on the low-liquid-repellency area. Thus, when the driver IC 14 applies a voltage to a predetermined one of the deriving electrodes 12 or the transfer electrodes 13, the ink can move to the insulating film 15 formed on the surface of the electrode 12 or 13, to which a voltage is applied. Incidentally, although depending upon the thickness of the insulating film 15 and the length of the ink transfer path 11, a voltage applied to the deriving electrode 12 or the transfer electrode 13 so as to move the ink I is relatively low. Electric power consumption at the time of moving the ink is reduced, as compared with a conventional piezoelectric actuator adapted to apply pressure to ink provided in the pressure chamber by deforming a piezoelectric layer.

Meanwhile, the liquid repellency of apart of the insulating film 15, which corresponds to the deriving electrode 12 to which no voltage is applied, is higher than that of the surface (that is, a surface of contact of liquid) of a portion of the substrate 2, which is provided near to the deriving port 10*a* of the common ink chamber 10. Therefore, in a case where no voltage is applied to the deriving electrode 12 of the predetermined ink transfer path 11, so that no ink is derived to this ink transfer path 11, the ink can surely be prevented from flowing out from the common ink chamber 10 due to the pulsation of the pressure of the ink.

Incidentally, the deriving electrode 12, the insulating film 15 provided on the surface of this driving electrode 12, and the common electrode 16, which are described in the foregoing description, function as a liquid deriving unit. Also, the plural transfer electrodes 13, the insulating film 15 provided on the surfaces of the transfer electrodes 13, and the common electrodes 16 function as a liquid transfer unit.

Next, the electrical configuration of the printing apparatus 1 is described hereinbelow by referring to a block view of FIG. 4.

This control unit 5 has a CPU (Central Processing Unit) serving as a central processor, a ROM (Read Only Memory), in which various kinds of programs and data for controlling an operation of the entire printing apparatus 1, and a RAM (Random Access Memory) for temporarily storing data to be processed by the CPU. Further, the control unit 5 has an ink transfer control portion 30 (functioning as an ink transfer control unit) for controlling an ink transfer operation of temporarily storing data to be processed by the CPU, practically, an operation of the driver IC 14 for applying a voltage to the deriving electrode 12 or to the transferring electrode 13. This ink transfer control portion 30 has the CPU, the ROM, and the RAM provided in the control unit 5.

Figure 4:
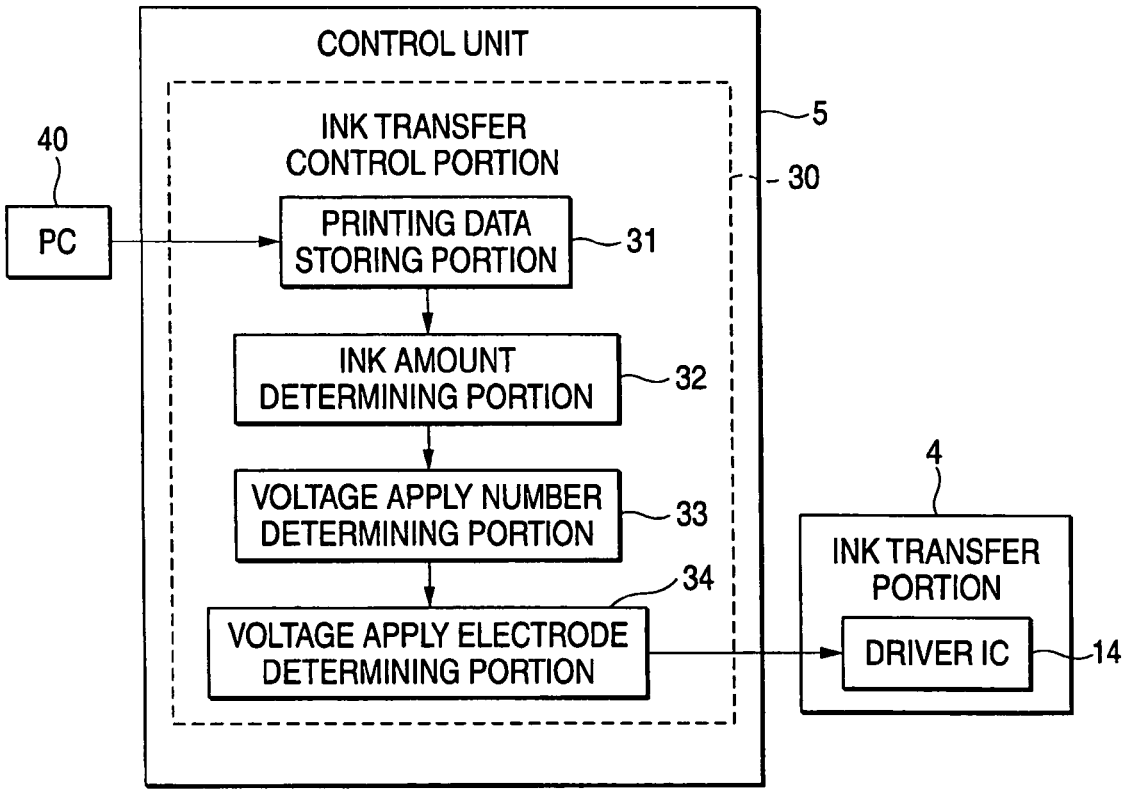
FIG. 4 is a functional block view illustrating the printing apparatus.

As shown in FIG. 4, the ink transfer control portion 30 has a printing data storing portion 31 for storing printing data inputted from a personal computer (PC) 40, an ink amount determining portion 32 for determining an amount of ink, which is transferred from the common ink chamber 10 to the ink transfer path 11 (or derived to the ink transfer path 11), according to the printing data stored in this printing data storing portion 31, a voltage apply number determining portion 33 (a voltage apply number determining unit) for determining the number of the electrodes 12 and 13, to which a voltage is simultaneously applied, according to the amount of ink, which is determined by this ink amount determining portion 32, and a voltage apply electrode determining portion 34 (a voltage apply electrode determining unit) for determining the deriving electrode 12 and the transfer electrode 13, to which a voltage is applied by the driver IC 14, according to the number of the electrodes 12 and 13, which is determined by the portion 33.

Figure 5:
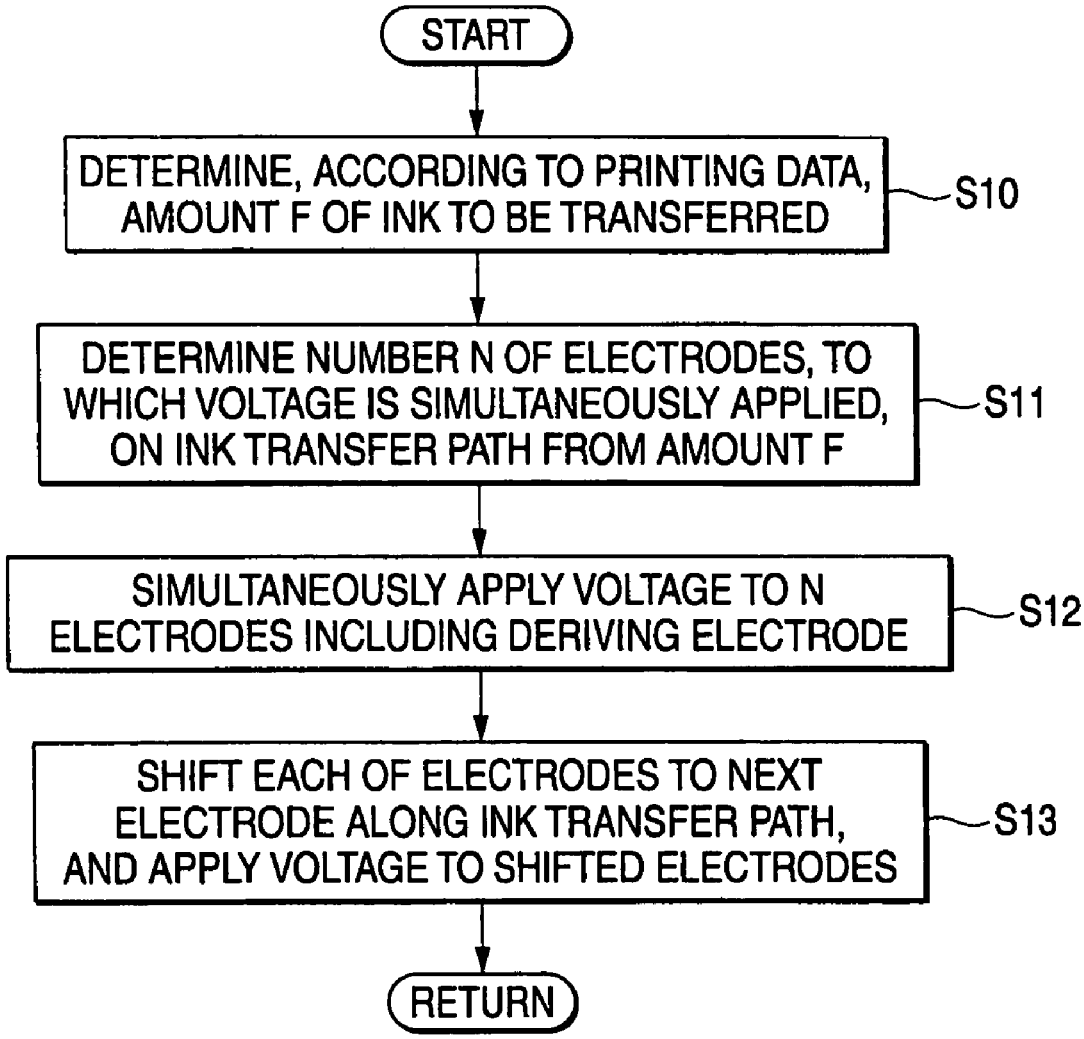
FIG. 5 is a flowchart illustrating an ink transfer process.

An ink transfer process to be performed by this ink transfer control portion 30 is described hereinbelow by referring to a flowchart of FIG. 5 and to FIGS. 6A to 6D. Incidentally, in the following description, reference characters Si (i=10, 11 . . . ) designates steps of the process.

First, an amount F of ink to be transferred by the ink transfer path 11 is determined in step S10 according to the printing data stored in the printing data storing portion 31. Incidentally, as described above, the five transfer electrodes 13 arranged in the second direction are electrically connected to each other. The driver IC 14 simultaneously applies a voltage to these five transfer electrodes 13. Thus, the amounts (that is, the amount of ink to be transferred) F of ink, which is derived to each of the ink transfer paths 11 and is transferred along this ink transfer path 11, are inevitably set to be equal to one another for the ink transfer paths 11.

Subsequently, the number of the electrodes 12 and 13, to which a voltage is applied, is necessary for deriving the amount F of the transferred ink and is determined in step S11 according to the amount F of ink, which is determined by the voltage apply number determining portion 33 in step S10. Incidentally, there is the necessity for applying a voltage to the deriving electrode 12 that adjoins the deriving port 10*a* of the common ink chamber 10 and that corresponds to the ink transfer path 11 to which ink is derived from the common ink chamber 10. In other words, whether or not ink is derived to the ink transfer path 11, on which the deriving electrode 12 is disposed, can appropriately be changed according to whether or not a voltage is applied to the deriving electrode 12. Further, as described above, the six electrodes (that is, the one deriving electrode 12 and the five transfer electrodes 13) disposed on each of the ink transfer paths 11 have the same surface area. Thus, amounts of ink moved onto the surfaces of parts of the insulating film 15, which respectively correspond to the electrodes 12 and 13, are equal to one another. Consequently, the amount F of transferred ink, which is determined in step S10, is proportional to the number of the electrodes to which a voltage is applied. Thus, the voltage apply number determining portion 33 calculates the total number N of the deriving electrode 12 and the one or plural transfer electrodes 13, which are arranged from the deriving electrode 12 and are adapted so that a voltage is simultaneously applied to the deriving electrode 12 and the transfer electrodes 13, by dividing the amount F of the transferred ink by an amount of ink that can be transferred by one of the electrodes 12 and 13. Incidentally, the number N of the electrodes corresponding to the ink transfer path 11, the amount F corresponding to which is 0, is 0. Thus, no voltage is applied to the deriving electrode 12. Consequently, no ink is derived to this ink transfer path 11 to the common ink chamber 10.

Figure 6A:
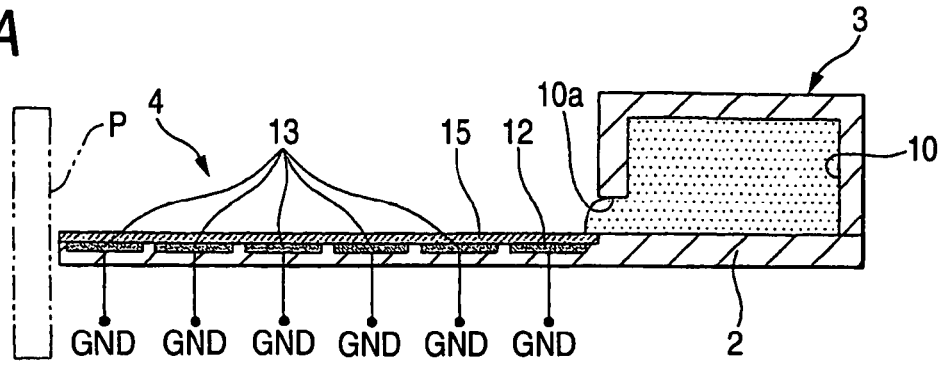
Figure 6B:
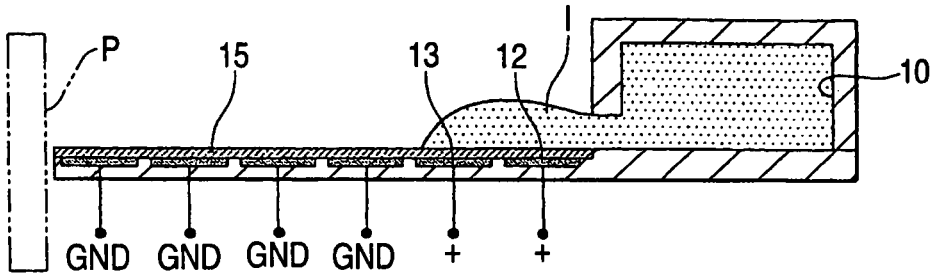
Figure 6C:
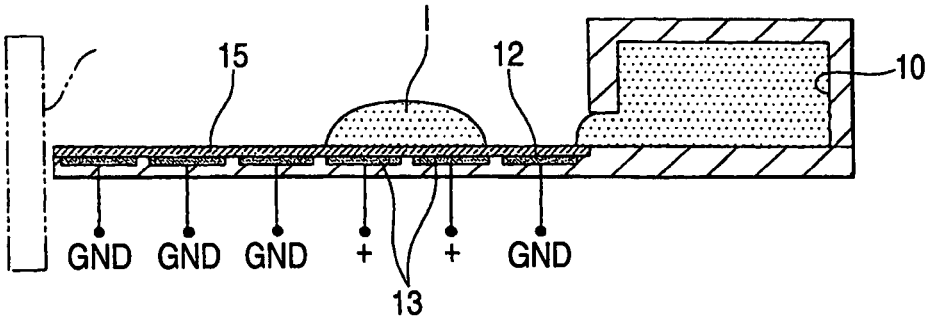

Subsequently, the electrodes, to which a voltage is applied, corresponding to the ink transfer path 11, to which ink is derived, are determined by the voltage apply electrode determining portion 34 to be N electrodes consisting of the deriving electrode 12 and the transfer electrodes 13 arranged in the first direction. The driver IC 14 simultaneously applies a voltage to the consecutively arranged N electrodes 12 and 13 in step S12. For example, in a case where the number N of the electrodes, to which a voltage is applied, is 2, when the voltage is applied, as shown in FIG. 6B, to the two electrodes, that is, the deriving electrode 12 and the transfer electrode 13 adjoining this deriving electrode 12 that correspond to the ink transfer path 11 to which ink is derived, during no voltage is applied to the deriving electrode 12 and the transfer electrode 13, as shown in FIG. 6A, the liquid repellency of the parts of the surface of the insulating film 15, which correspond to these two electrodes 12 and 13, is lowered. Then, the amount F of the ink I to be transferred is derived to the surfaces of the electrodes 12 and 13 from the common ink chamber 10. Incidentally, the insulating film 15 is also formed on a gap area placed outside the ink transfer paths 11. Thus, the liquid repellency of this gap area does not change and is always in a high-liquid-repellency condition. Consequently, there is no fear that the ink I derived onto the surfaces of the electrodes 12 and 13 moves to the gap area.

Figure 6D:
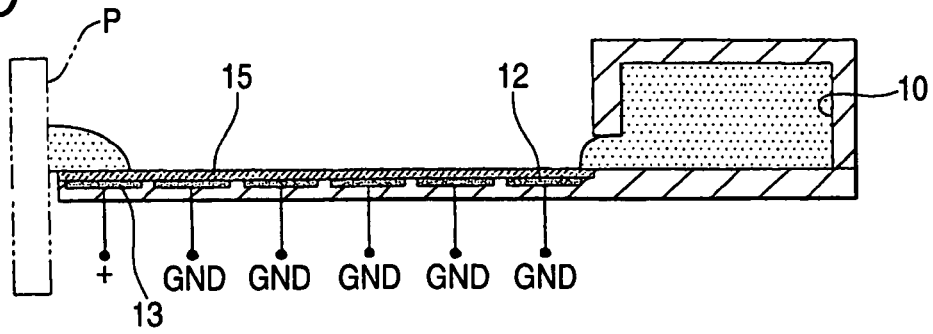

Then, the voltage apply electrode determining portion 34 determines the transfer electrode 13, to which a voltage is next applied, as the transfer electrodes 13 disposed next to and shifted from the deriving electrode 12 or the transfer electrode 13, to which the voltage is applied the last time, along the ink transfer path 11. Furthermore, the driver IC 14 simultaneously applies a voltage to the determined transfer electrodes 13 in step S13. Practically, in a case where the number N of the electrodes, to which the voltage is applied, is 2, the state, in which the voltage is simultaneously applied to the deriving electrode 12 and the transfer electrode 13 adjoining this deriving electrode 12, as shown in FIG. 6B, is changed to a state wherein the transfer electrodes 13, to which the voltage is applied, are changed to two of the electrodes, that is, the second and third transfer electrodes 13 from the right, as viewed in FIG. 6C, among the six electrodes shown in FIGS. 6A to 6D and wherein the ink is moved to the surfaces of these two transfer electrodes 13. Additionally, the transfer electrodes 13, to which a voltage is applied, are shifted one by one along the ink transfer path 11, so that ink is moved to an end portion of the ink transfer path 11. Then, as shown in FIG. 6D, the voltage is applied only to the transfer electrode 13 placed at the leftmost end, as viewed in FIGS. 6A to 6D, to thereby eliminate possibility of moving the ink in a direction other than the direction directed to the recording paper P. Subsequently, a voltage is prevented from being applied to the transfer electrode placed at the leftmost end, while the ink is caused to penetrate into the recording paper P. Thus, all the ink derived to the ink transfer path 11 is moved to the recording paper P, which is then printed.

The aforementioned printing apparatus 1 obtains the following advantages.

That is, ink can easily be derived to a predetermined one of the ink transfer paths 11 by applying a voltage to the deriving electrode 12 placed on the predetermined ink transfer path 11. Also, the derived ink can be moved to the recording paper P through the ink transfer path 11 by changing the transfer electrodes 13, to which a voltage is applied, along the ink transfer path 11. Thus, ink is selectively derived to the five ink transfer paths 11. Additionally, the configuration of a device for moving ink to the recording paper P on the ink transfer path 11, to which ink is derived, can be simplified. Consequently, the manufacturing cost of the printing apparatus 1 can be reduced.

All the deriving electrode 12 and the transfer electrodes 13 corresponding to each of the ink transfer paths 11 have the same value of the area. Also, the number of the deriving electrode 12 and the transfer electrodes, to which a voltage is simultaneously applied, is determined according to the printing data by the voltage apply number determining portion 33. That is, the amount of ink derived to the ink transfer path can easily be adjusted by changing the number of the deriving electrode 12 and the transfer electrodes 13.

Next, modifications obtained by making various alterations to the aforementioned embodiment are described hereinbelow. Incidentally, composing elements similar to those of the aforementioned embodiment are designated by the same reference character. Thus, the description of such elements is omitted herein.

1) The printing apparatus of the aforementioned embodiment is configured by adjusting the number of the deriving electrodes 12 and the transfer electrodes 13, to which a voltage is applied, by the voltage apply number determining portion 33 according to the amount F of the into to be transferred, so that a predetermined amount of ink flows into the ink transfer path 11. However, as described hereinbelow, the printing apparatus (First Modification) may be configured so that the amount of ink to be derived can be adjusted by controlling a time during which a voltage is applied to the deriving electrode 12 corresponding to the ink transfer path 11.

Figure 7:
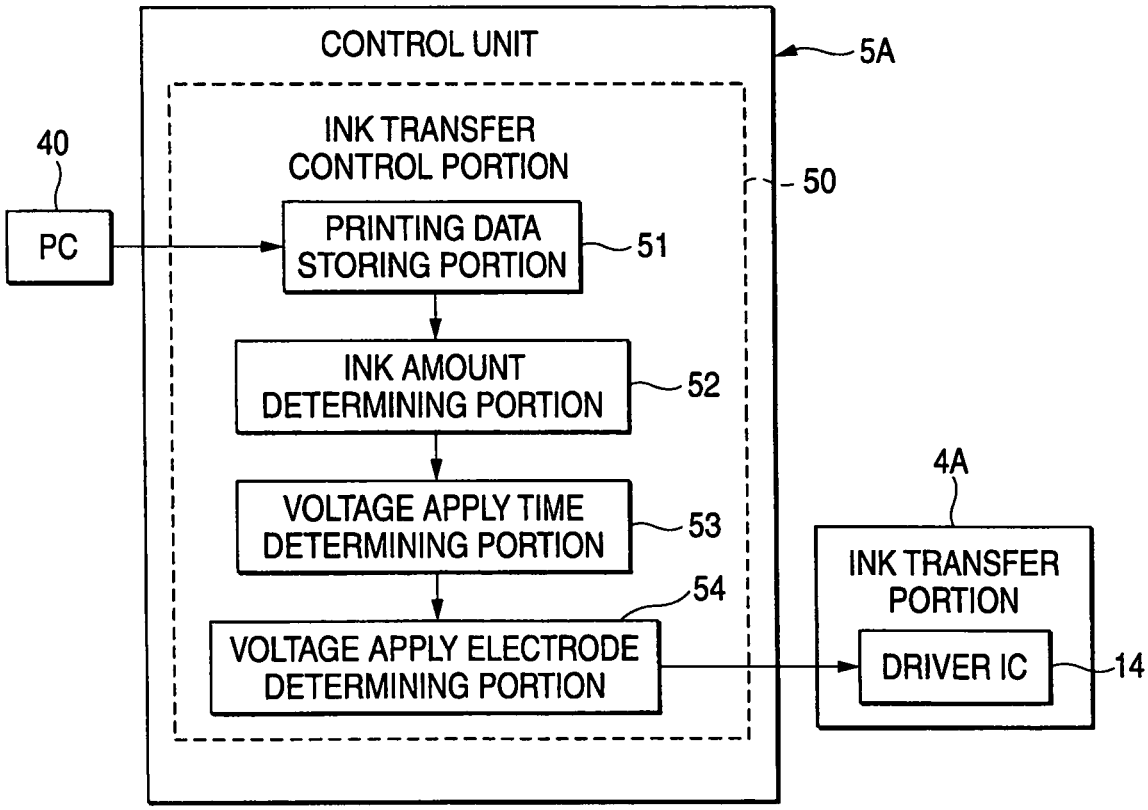
FIG. 7 is a functional block view illustrating a printing apparatus according to a first modification of the embodiment.

As shown in FIG. 7, an ink transfer control portion 50 of a control unit SA of this first modification has a voltage apply time determining portion 53 (functioning as a voltage apply time determining unit) adapted for determining a voltage application time, during which a voltage is applied to the deriving electrode 12 placed on the ink transfer path 11, according to the amount F of ink to be transferred, which is determined by the ink amount determining portion 52, in addition to a printing data storing portion 51, an ink amount determining portion 52, and a voltage apply electrode determining portion 54 for determining the electrodes to which a voltage is applied. An ink transfer process performed by this ink transfer control portion 50 is described hereinbelow with reference to a flowchart of FIG. 8.

Figure 8:
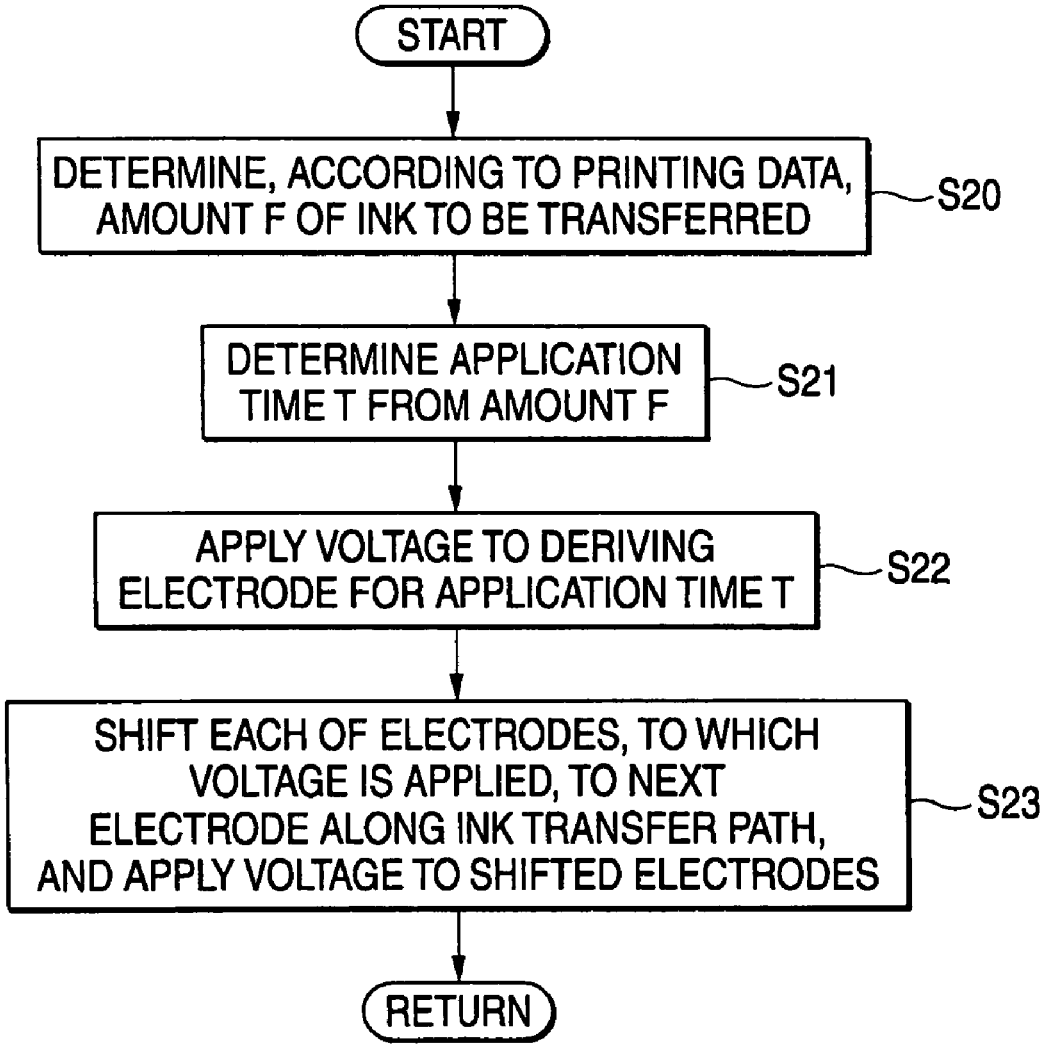
FIG. 8 is a flowchart illustrating an ink transfer process performed in the first modification.

As shown in FIG. 8, first, the ink amount determining portion 52 determines an amount F of ink transmitted on the ink transfer path 11 (that is, an amount of ink derived to the ink transfer path 11) according to printing data in step S20. Subsequently, in step S21, the voltage apply time determining portion 53 calculates a voltage application time T, during which a voltage is applied to the deriving electrode 12 corresponding to the ink transfer path 11, according to the amount F of ink to be transferred, which is determined in step S20. Incidentally, this voltage application time T is determined to be a value that is proportional to the amount F of ink to be transferred. Then, the voltage apply electrode determining portion 54 determines the deriving electrode 12 to which a voltage is applied. The driver IC 14 of the ink transfer portion 4A applies a voltage to this deriving electrode 12 for a voltage application time T. Thus, ink is moved onto a part of the insulating film 15, which is placed on the surface of the deriving electrode 12, from the common ink chamber 10 in step S22. Consequently, a predetermined amount of ink can be derived to the surface of the deriving electrode 12 from the common ink chamber 10 by adjusting the voltage application time T. Thereafter, similarly to the aforementioned embodiment, the voltage is applied by shifting the electrodes, to which the voltage is applied, to the next one along the ink transfer path 11 in step S23. Thus, ink is transferred to the recording paper P.

2) The printing apparatus 1 of the aforementioned embodiment is adapted so that the five transfer electrodes 13 arranged in the second direction are electrically connected to each other, and that a voltage is simultaneously applied to these five transfer electrodes 13. The printing apparatus 1 (Second Modification) maybe configured so that voltages are individually applied to the five transfer electrodes 13.

Figure 9:
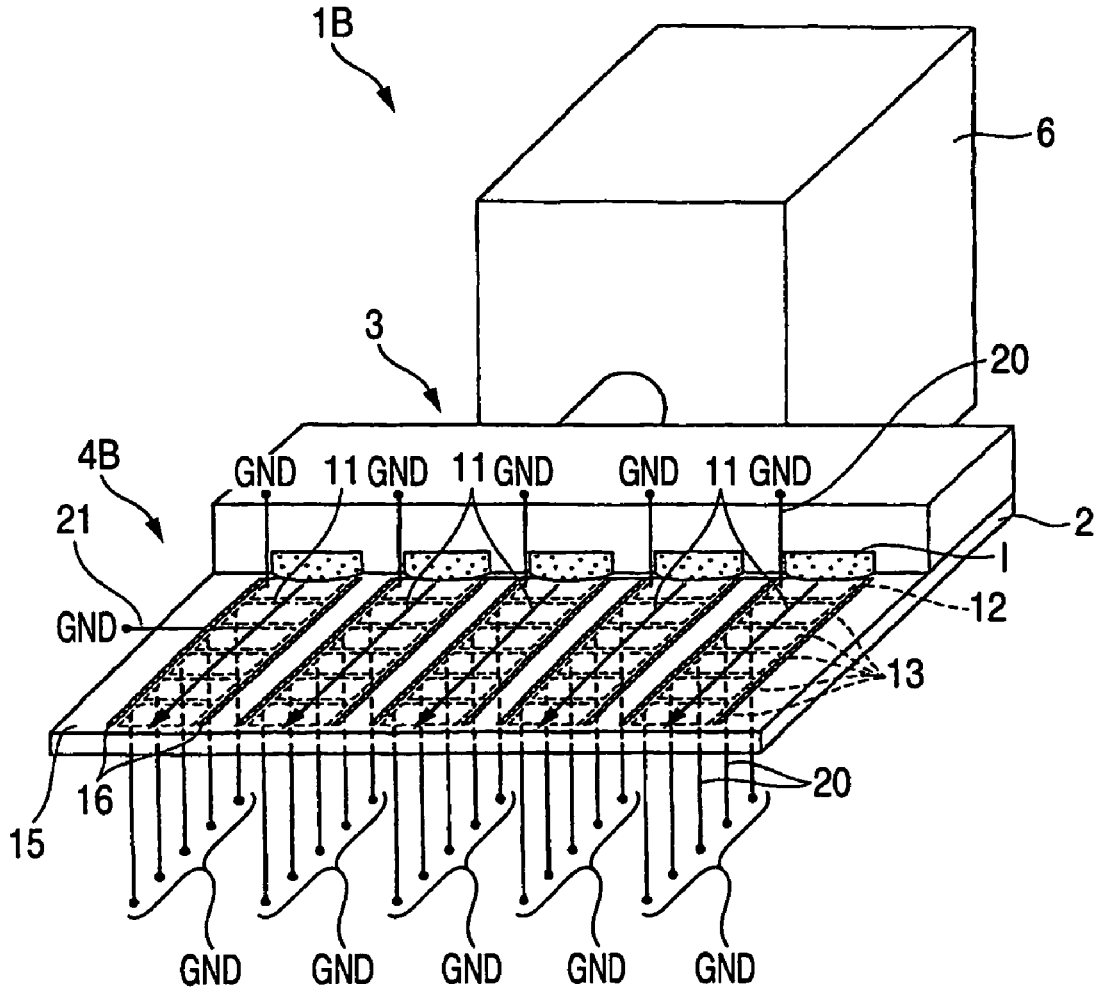
FIG. 9 is a schematic perspective view illustrating a printing apparatus according to a second modification of the embodiment.
Figure 10:
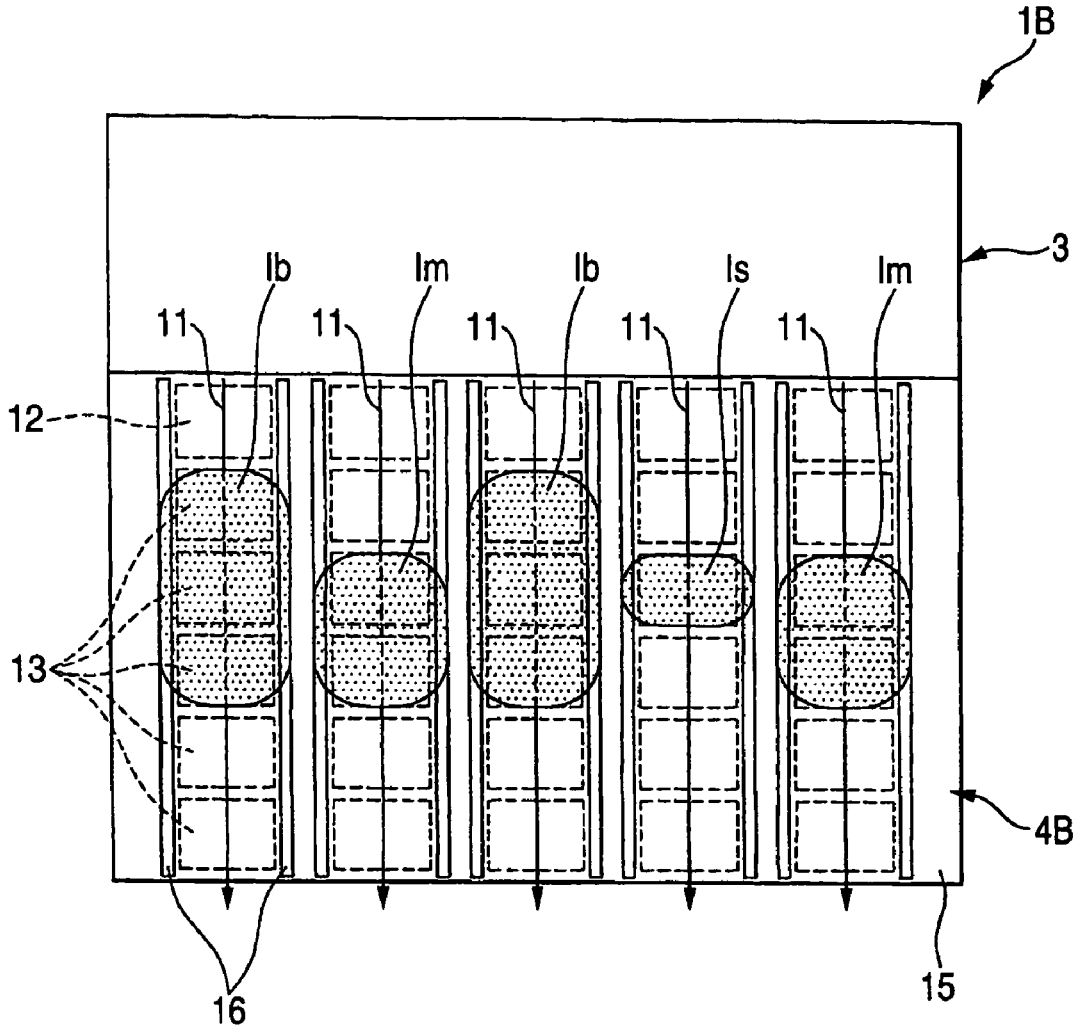
FIG. 10 is a plan view illustrating the printing apparatus according to the second modification.

As shown in FIG. 9, five wiring portions 20 are connected to the five transfer electrodes 13 placed on each of the ink transfer paths 11 in an ink transfer portion 4B of a printing apparatus 1B of this modification. A driver IC 14 supplies voltages to these five transfer electrodes 20 individually (see FIG. 11). Thus, this printing apparatus 1B is enabled to perform what is called gray-scale printing by adjusting the number of the electrodes 12 and 13, to which a voltage is simultaneously applied, on each of the ink transfer paths 11 and by transferring different amounts of ink (that is, small droplets, medium droplets, and large droplets of ink) to the ink transfer paths 11, respectively, as shown in FIG. 10.

Incidentally, the deriving electrodes 12 and the transfer electrodes 13 in this example achieve the same function and serve as a liquid deriving and transferring unit.

Figure 11:
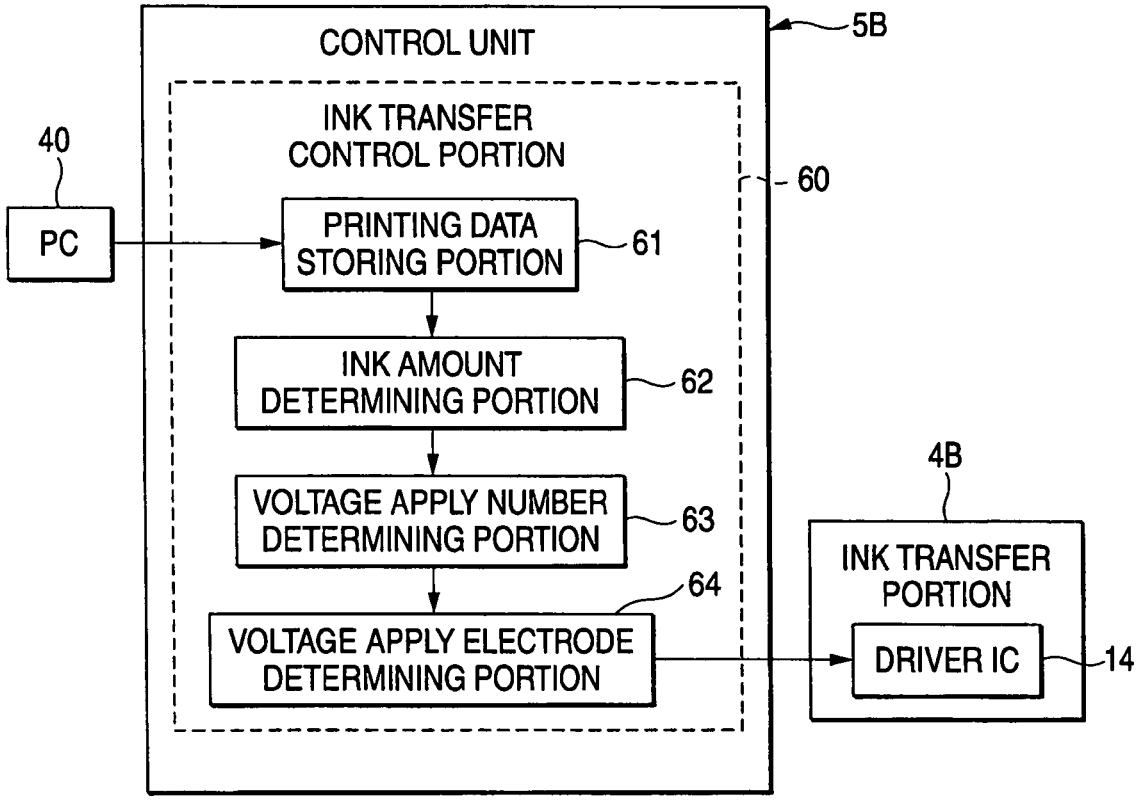
FIG. 11 is a functional block view illustrating the printing apparatus according to the second modification.
Figure 12:
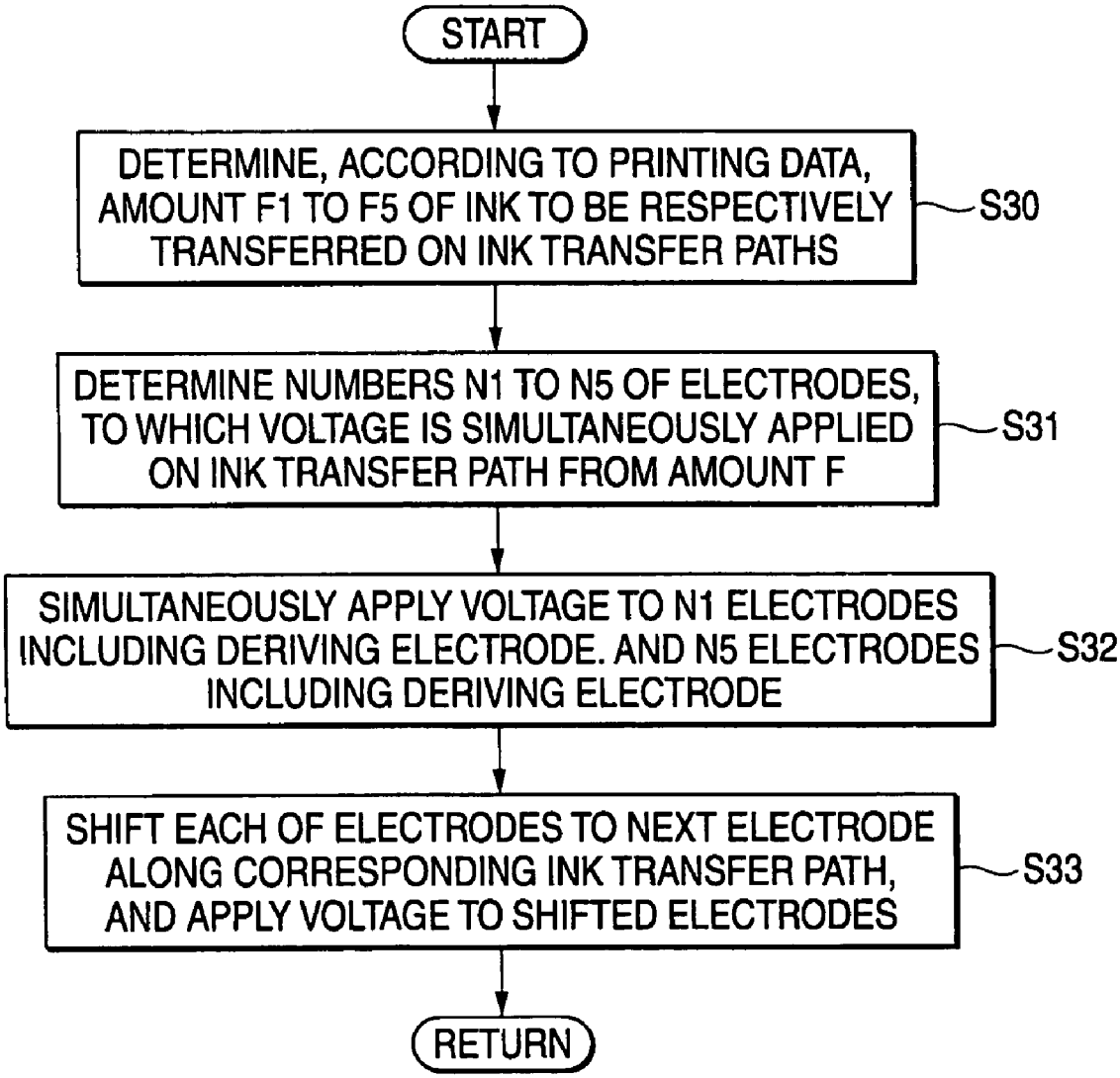
FIG. 12 is a flowchart illustrating an ink transfer process performed in the second modification.

As shown in FIG. 11, in this printing apparatus 1B, an ink transfer control portion 60 of a control unit 5B has a printing data storing portion 61, an ink amount determining portion 62, a voltage apply number determining portion 63 for determining the number of electrodes, to which a voltage is simultaneously applied, and a voltage apply electrode determining portion 64 for determining the electrodes to which a voltage is applied. Hereinafter, an ink transfer process performed by this ink transfer control portion 60 is described by referring to a flowchart of FIG. 11 and to FIGS. 12 to 14.

First, the ink amount determining portion 62 determines amounts F1 to F5 of ink, which is transferred by the five ink transfer paths 11 to the recording paper, in step S30. Incidentally, the amounts F1 to F5 of ink to be transferred are determined to be values of three kinds of amounts of ink, which respectively correspond to a small droplet Is of ink, a medium droplet Im of ink, and a large droplet Ib of ink (see FIG. 10) or to be 0 corresponding to a case where no ink is transferred.

Subsequently, the voltage apply number determining portion 63 determines the numbers N1 to N5 of electrodes, to which a voltage is applied, on the five ink transfer paths 11, respectively, in step S31 according to the amounts F1 to F5 of ink, which are determined in step S30. Practically, as shown in FIG. 10, in a case where the amount of ink to be transmitted is that of ink corresponding to a small droplet Is, the number of electrodes, to which a voltage is applied, is 1. In a case where the amount of ink to be transmitted is that of ink corresponding to a medium droplet Im, the number of electrodes, to which a voltage is simultaneously applied, is 2. Also, in a case where the amount of ink to be transmitted is that of ink corresponding to a large droplet Ib, the number of electrodes, to which a voltage is simultaneously applied, is 3. Further, in a case where no ink is transferred, no voltage is applied to the deriving electrode 12 and the transfer electrode 13. Thus, the number of the electrodes, to which a voltage is applied, is 0.

Further, the voltage apply electrode determining portion 64 determines such electrodes to be the number N1 of electrodes, which include the deriving electrode 12 and the transfer electrodes arranged in the first direction from this deriving electrode 12, . . . and the number N5 of electrodes, which include the deriving electrode 12 and the transfer electrodes arranged in the first direction from this deriving electrode 12, respectively corresponding to the five ink transfer paths 11. Also, the driver IC 14 simultaneously applies a voltage to the number N1 of the electrodes . . . and the number N5 of the electrodes in step S32. Thus, the amount F1 of ink, . . . and the amount F5 of ink are derived to the five ink transfer paths 11, respectively. Furthermore, the voltage apply electrode determining portion 64 determines the transfer electrodes 13, to which a voltage is next applied, to be the transfer electrodes 13 shifted one by one from the deriving electrode 12 or from the transfer electrode 13, to which the voltage is applied the last time, along each of the ink transfer paths 1. Then, the driver IC 14 simultaneously applies a voltage to the determined transfer electrodes in step S33.

Figure 13A:
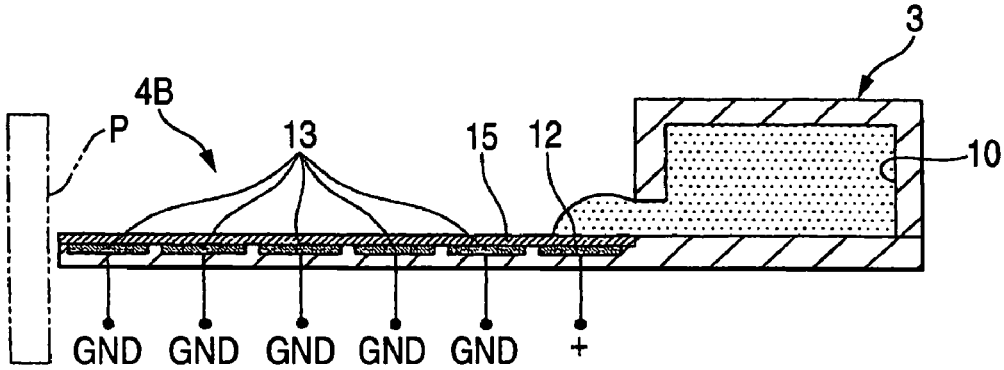
Figure 13B:
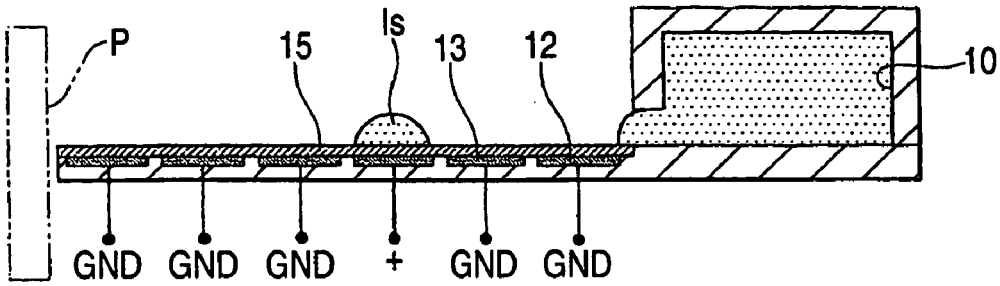

That is, in the case of the ink transfer path 11 (the fourth ink transfer path 11 from the left, as viewed in FIG. 10) on which the small droplet Is of ink is transferred, a voltage is applied only to the deriving electrode 12, and the small droplet Is of ink is derived to this deriving electrode, as shown in FIG. 13A. Then, the transfer electrode 13, on which the voltage is applied, is shifted one by one along the ink transfer path 11, as shown in FIG. 13B. Thus, the small droplet Is of ink is transferred to the recording paper P.

Figure 14A:
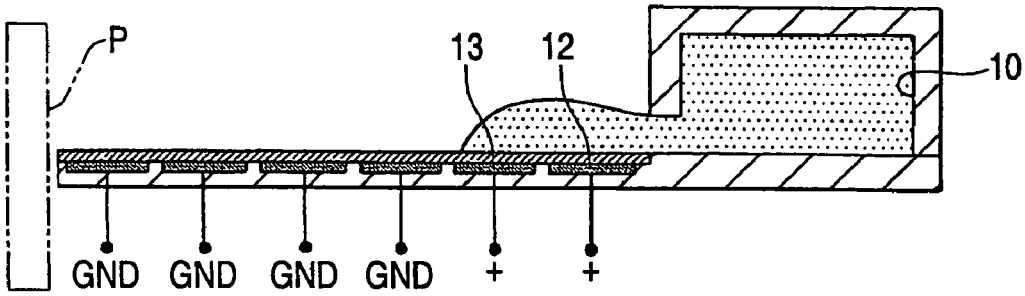
Figure 14B:
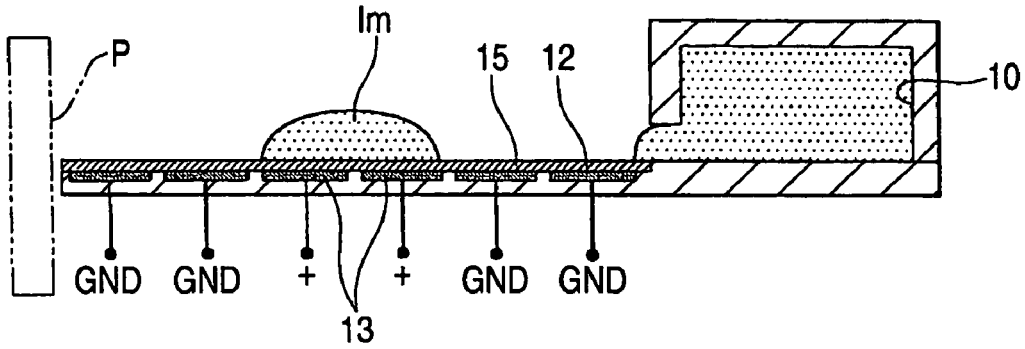

Further, in the case of the ink transfer path 11 (the second and fifth ink transfer paths 11 from the left, as viewed in FIG. 10) on which the medium droplet Im of ink is transferred, a voltage is simultaneously applied to the deriving electrode 12 and the one transfer electrode 13 adjoining this deriving electrode 12, that is, a total of two electrodes, and the medium droplets Im of ink are derived to the surfaces of the two electrodes 12 and 13, as shown in FIG. 14A. Then, each of the transfer electrodes 13, on which the voltage is applied, is shifted one by one along the ink transfer path 11, as shown in FIG. 14B. Thus, the medium droplets Im of ink are transferred to the recording paper P.

Figure 15A:
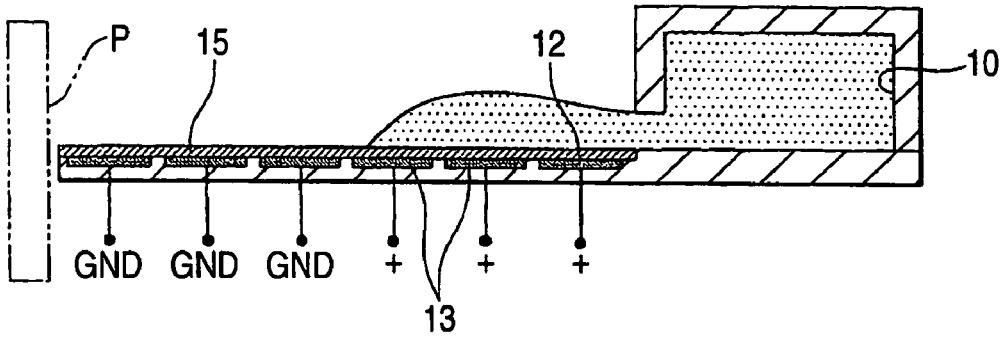
Figure 15B:
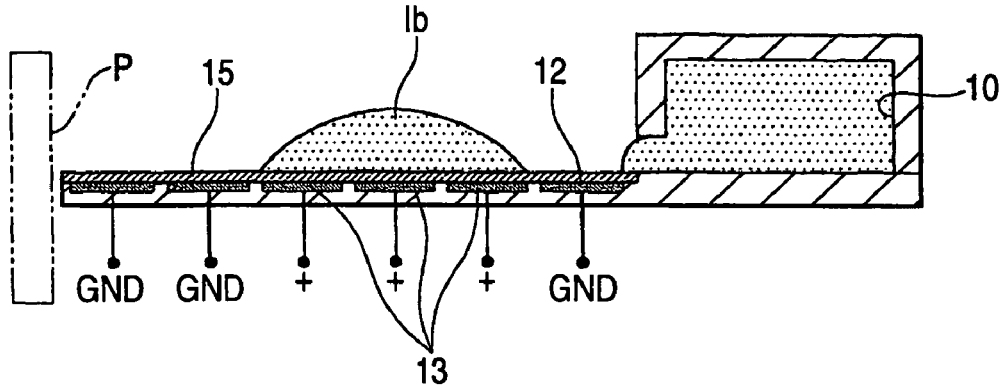

Furthermore, in the case of the ink transfer path 11 on which the large droplet Ib of ink is transferred, a voltage is simultaneously applied to the deriving electrode 12 and the two transfer electrode 13 consecutively arranged from this deriving electrode 12, that is, a total of three electrodes, and the large droplets Ib of ink are derived to the surfaces of the three electrodes 12 and 13, as shown in FIG. 15A. Then, each of the transfer electrodes 13, on which the voltage is applied, is shifted one by one along the ink transfer path 11, as shown in FIG. 15B. Thus, the large droplets Ib of ink are transferred to the recording paper P.

Consequently, in the printing apparatus 1B, different amounts of ink can be transferred on the five ink transfer paths 11. At that time, as shown in FIG. 10, among the transfer electrodes 13 of five lines arranged in the second direction over the five ink transfer paths 11, a voltage is simultaneously applied to the transfer electrodes 13 of one of the lines (that is, the third line from the top, as viewed in FIG. 10 among the electrodes of six lines shown in this figure). Therefore, a difference in timing, with which each of the droplets of ink transferred reaches the recording paper P, among the droplets of ink respectively transferred on the five ink transfer paths 11 can be reduced. Consequently, an occurrence of a positional difference among droplets of ink adhering to the recording paper P can be prevented as much as possible. Also, the printing quality of the apparatus can be improved.

3) Although the printing apparatus 1 of the aforementioned embodiment is configured so that ink derived to the ink transfer path 11 is transferred to the recording paper P without being changed, the printing apparatus may be configured so that the derived ink is divided into two or more portions halfway through the transfer thereof, and that only a part of the ink derived to the ink transfer path 11 is transferred to the recording paper P (Third Modification).

Figure 16:
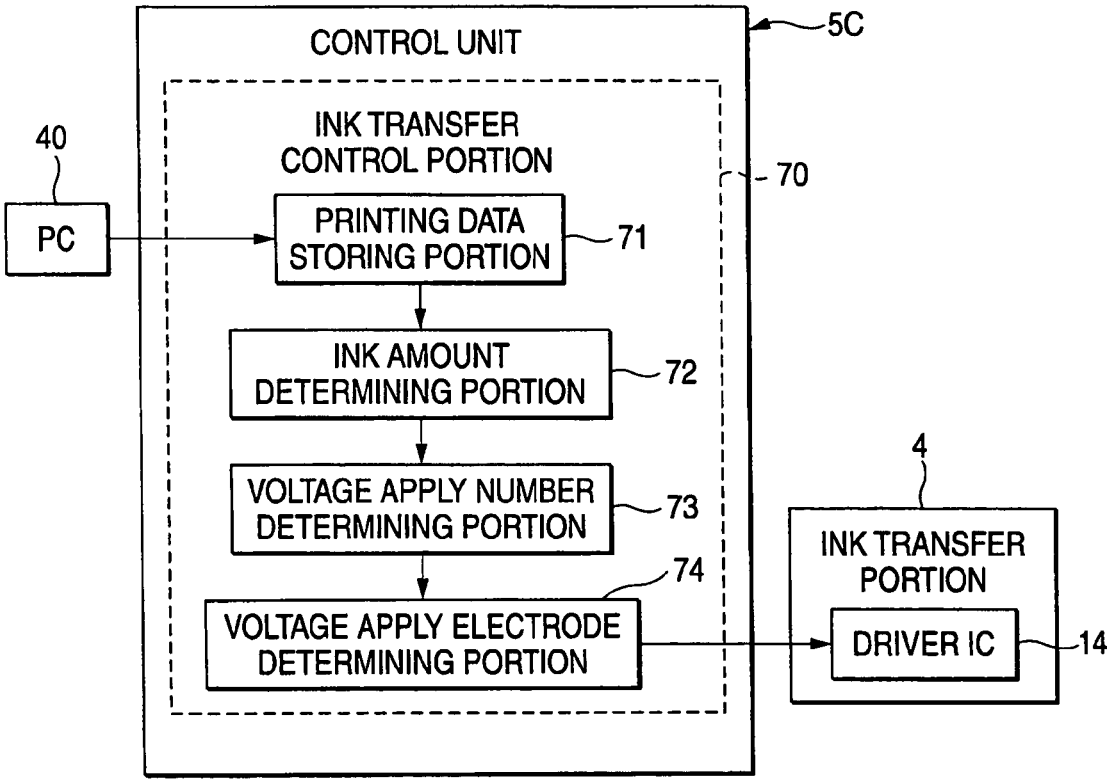
FIG. 16 is a functional block view illustrating a printing apparatus according to a third modification of the embodiment.
Figure 17:
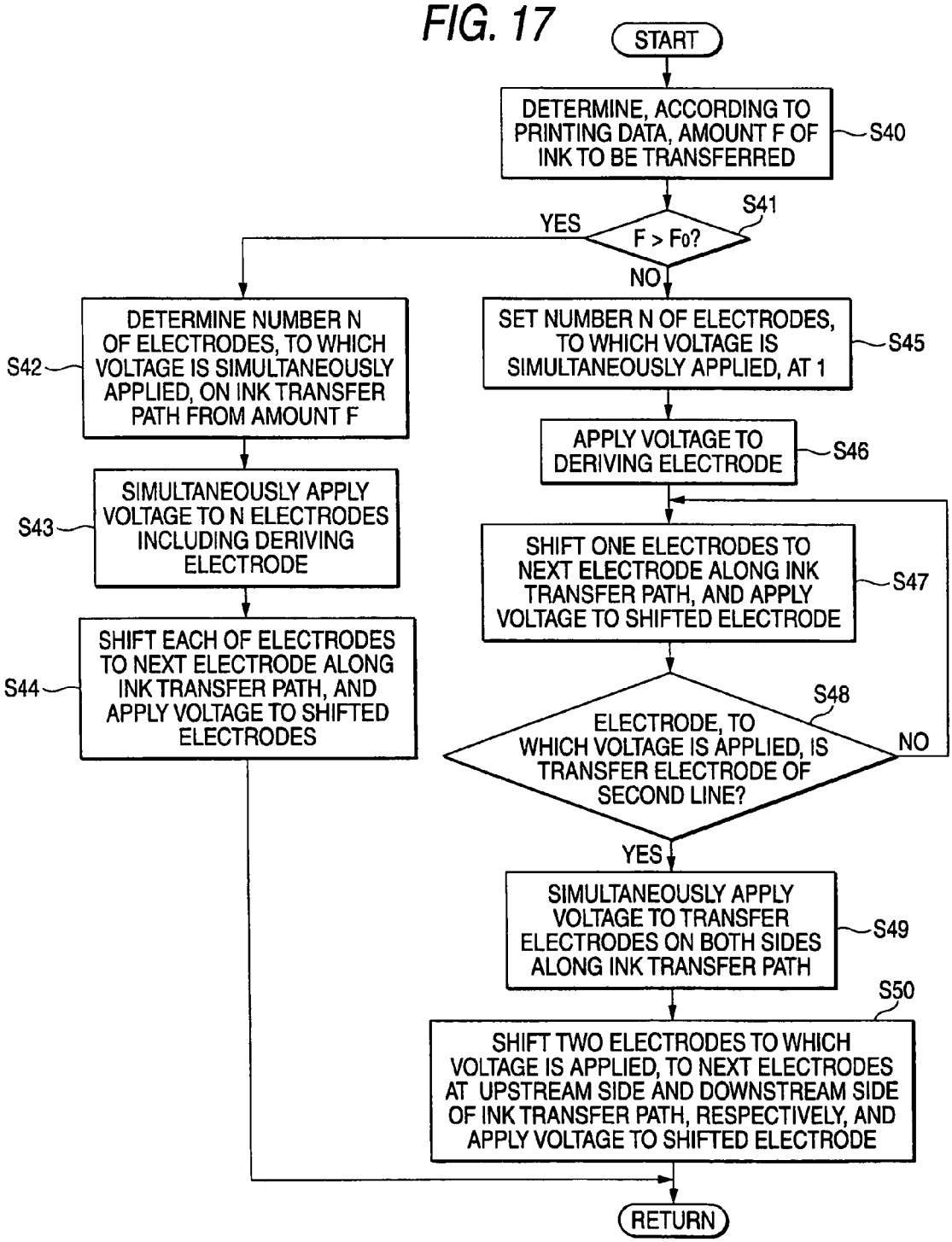
FIG. 17 is a flowchart illustrating an ink transfer process performed in the third modification.

As shown in FIG. 16, an ink transfer control portion 70 of a control unit 5C of the third modification has a printing data storing portion 71, a ink amount determining portion 72 (functioning as a liquid amount determining unit), a voltage apply number determining portion 73 for determining the number of electrodes to which a voltage is applied, and a voltage apply electrode determining portion 74 for determining the electrodes to which a voltage is applied. Hereinafter, an ink transfer process performed by this ink transfer control portion 70 is described with reference to a flowchart of FIG. 17 and to FIG. 18.

First, the ink amount determining portion 72 determines an amount F of ink transferred by a predetermined one of the ink transfer paths 11 in step S40. Incidentally, if the determined amount F of ink to be transferred is more than an amount F0 of ink that can be transferred by the one electrode 12 or 13, to which a voltage is applied (that is, if Yes in step S41), the voltage apply number determining portion 73 determines the number N of electrodes, to which a voltage is applied, in step S42, similarly to the aforementioned embodiment. Then, ink is derived to the ink transfer path 11 by simultaneously applying a voltage to the electrodes determined by the voltage apply electrode determining portion 74 instep S43. Subsequently, the driver IC of the ink transfer portion 4C shifts each of the transfer electrodes 13, on which the voltage is applied, one by one along the ink transfer path 11, and applies a voltage thereto in step S44. Thus, the ink is transferred to the recording paper P.

Figure 18A:
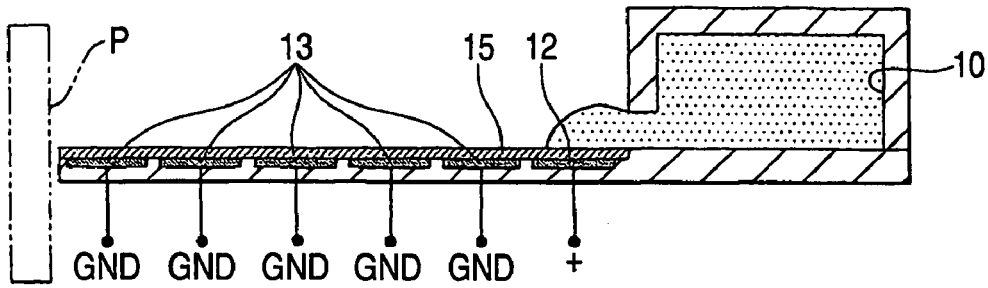

On the other hand, if the determined amount F of ink to be transferred is less than an amount F0 of ink that can be transferred (that is, if No in step S4, meanwhile, in step S45, the voltage apply number determining portion 73 determines the number N of electrodes, to which a voltage is applied, to be 1. Then, in step S46, the voltage apply electrode determining portion 74 determines such an electrode to be the deriving electrode 12, and applies the voltage to the electrode 12. Thus, as shown in FIG. 18A, the amount F0 of ink is derived to the ink transfer path 11. Subsequently, the voltage apply electrode determining portion 74 shifts each of the transfer electrodes 13, on which the voltage is applied, one by one along the ink transfer path 11 in step S47. Thus, as shown in FIG. 18B, the amount F0 of ink I is moved to the position of the transfer electrode 13 of the second line (that is, among the six electrodes shown in FIGS. 18A and 18B, the third electrode from the right).

Figure 18B:
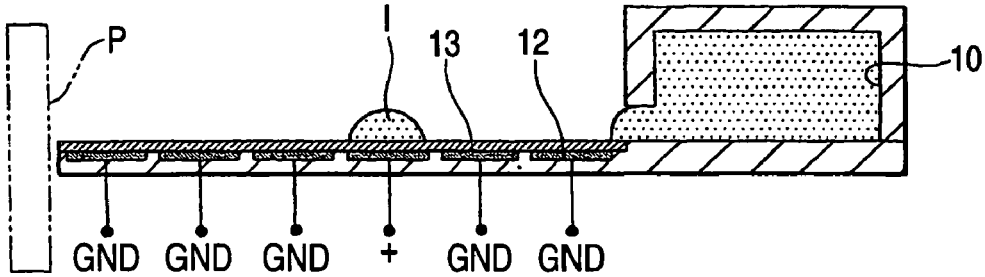
Figure 18C:
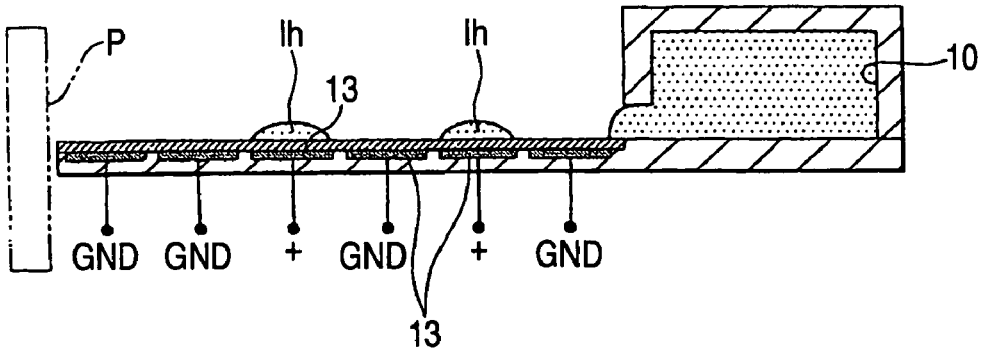

When the ink I is moved to the position of the transfer electrode 13 of the second line (that is, if Yes in step S48), the voltage apply electrode determining portion 74 changes the electrodes, to which a voltage is applied, to two transfer electrodes 13 (that is, the second and fourth electrodes from the right, as viewed in FIGS. 18A to 18C), one of which is provided at the upstream side (that is, the right side, as viewed in FIGS. 18A to 18C) of the ink transfer path 11, and the other of which s provided at the downstream side (that is, the left side, as viewed in FIGS. 18A to 18C) of the ink transfer path 11. Also, a voltage is simultaneously applied to these two transfer electrodes 13 in step S49. Then, as shown in FIG. 18C, the liquid repellency of the surfaces of the parts of the insulating film placed on the surfaces of the two transfer electrodes 13, on which the ink I is placed, is increased. Simultaneously, the liquid repellency of the surfaces of each of the parts of the insulating film, which are placed on the surfaces of the two transfer electrodes 13 respectively provided at the upstream side and the downstream side of the ink transfer path 11, is reduced. Thus, the ink I is moved to the surface of each of the two transfer electrodes 13 and is divided into two ink droplets Ih, the amount of each of which is substantially equal to F0/2. Then, the voltage apply electrode determining portion 74 shifts the two electrodes, to which a voltage is applied, to the next upstream-side electrode and the next downstream-side electrode, respectively. Subsequently, a voltage is simultaneously applied to the tow electrodes, to which the voltage is applied, in step S50. The ink Ih at the downstream side is moved to the recording paper P. On the other hand, the ink Ih at the upstream side is returned to the common ink chamber 10. Thus, the ink I derived to the ink transfer path 11 can be divided halfway through the transfer thereof. Consequently, a small droplet Ih of ink can be transferred to the recording paper P. The portion 74, which has been described in the foregoing description and is adapted to perform processing in step S49, for determining the electrodes, to which a voltage is applied, functions as the liquid dividing means according to the invention.

Incidentally, the number of division of ink is not limited to 2. A smaller droplet of ink can be transferred to the recording paper P by dividing the divided ink. Also, multilevel gray-scale printing, the number of gray-scale levels of which is equal to or more than 4, is enabled by combining with the second modification, which can perform three-level gray-scale printing (having three levels respectively corresponding to a small droplet, a medium droplet, and a large droplet), with the third modification.

Figure 19:
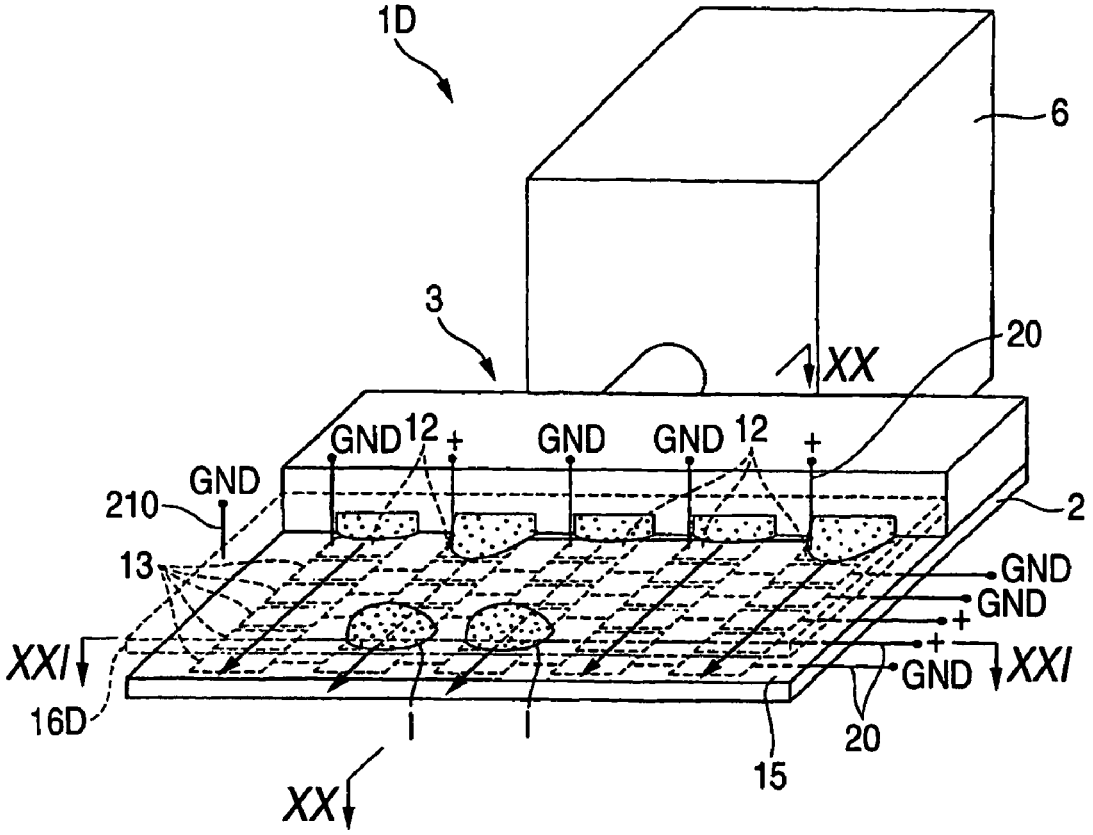
FIG. 19 is a schematic perspective view illustrating a printing apparatus according to a fourth modification of the embodiment.
Figure 20:
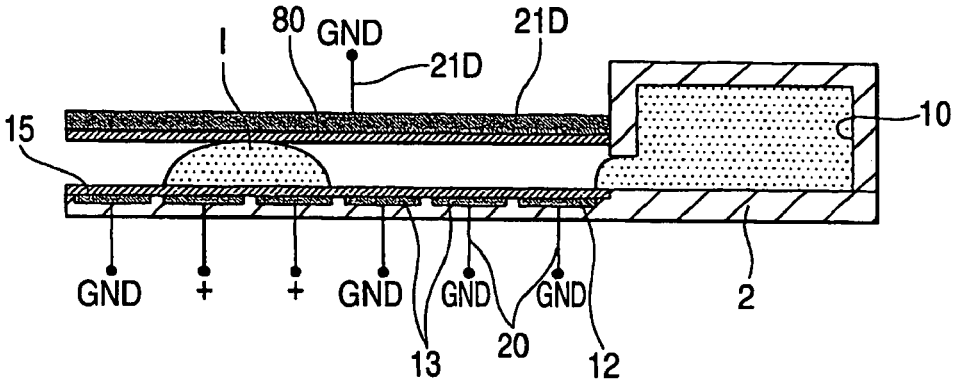
FIG. 20 is a cross-sectional view taken along line XX-XX shown in FIG. 19.
Figure 21:
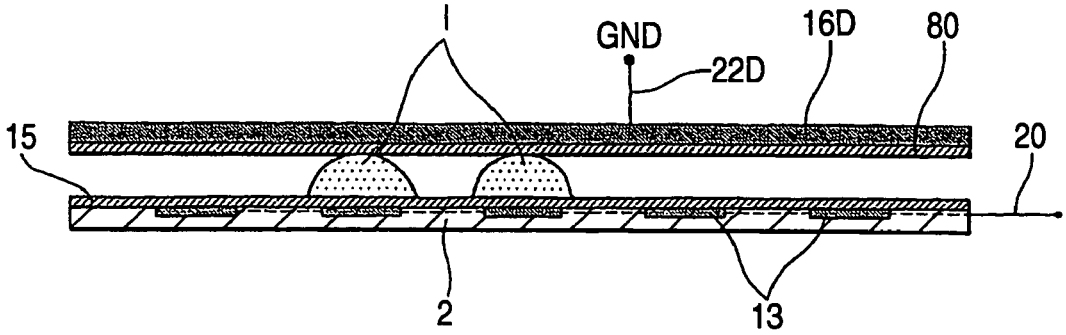
FIG. 21 is a cross-sectional view taken along line XXI-XXI shown in FIG. 19.

4) As shown in FIGS. 19 to 21, in a printing apparatus 1D, a common electrode 16D may be formed on a surface upwardly spaced from an insulating film 15, which is continuously formed on the surfaces of the deriving electrode 12 and the transfer electrodes 13 (Fourth Modification). This common electrode 16D is formed like a continuous sheet facing all the deriving electrode 12 and the transfer electrodes 13. Further, as shown in FIGS. 20 and 21, the common electrode 16D is in contact with ink I, which moves on the ink transfer path 11, through an insulating film 80. The common electrode 16D is held at a ground potential level. Furthermore, when a voltage is applied the predetermined deriving electrode 12 or the predetermined transfer electrode 13, a difference in electric potential is caused between the ink I, which is held at the ground potential level, similarly to the common electrode 16D, and the electrode 12 or 13, to which a voltage is applied. Thus, the liquid repellency of the part of the insulating film 15, which are placed on the surface of the electrode 12 or 13, is reduced. Consequently, the ink is moved. In this fourth modification, the number of wiring portions 21D for the common electrode 16D can be set to be 1. Also, wiring portions 20 for the deriving electrode 12 and the transfer electrode 13 can be set apart from a wiring portion 21D for the common electrode 16D. Thus, the density of the wiring portions 29 and 21D for these electrodes, 12, 12, and 16D can be reduced. Consequently, the manufacture of the printing apparatus 1D is facilitated.

5) The common electrode 16 is not necessarily disposed in the ink transfer portion 4. For example, the common electrode may be placed in the common ink chamber 10 of the ink supply portion 3. In this case, ink is held at the ground potential level in the common ink chamber 10. However, after the ink is derived from the common ink chamber 10 to the ink transfer path 11, the ink is not in contact with the common electrode. Therefore, to be more accurate, the ink is not held at the ground potential level. However, the potential level of the ink, which moves on the ink transfer path 11, does not abruptly change. Thus, it is possible that the ink is moved on the surface of the insulating film 15 by, for instance, slightly changing the voltage to be applied to the deriving electrode 12 and the transfer electrode 13 thereby to cause a necessary difference in electric potential between both surfaces of the insulating film provided between the ink and the electrode 12 or 13.

6) The surface areas of the deriving electrodes 12 and the transfer electrodes 13 are not necessarily equal to one another. For example, the surface areas thereof may be changed according to the arrangement order from the common ink chamber 10. In this case, when an amount of ink, which enables the ink to the electrodes 12 and 13 having different surface areas, is preliminarily set, the amount of ink derived to the ink transfer path 11 can be adjusted by changing the number of electrodes 12 and 13, to which a voltage is applied, similarly to the aforementioned embodiment.

7) The ink transfer means for transferring the ink, which is derived onto the deriving electrode 12 disposed on the ink transfer path 11, to the recording paper P is not limited to that utilizing the electrowetting phenomenon. For example, the ink transfer path may be inclined so that the ink transfer path is reduced in height toward a downward side, thereby to cause the ink, which is derived onto the deriving electrode 112, to move to the recording paper P along the ink transfer path by gravitation.

Figure 22:
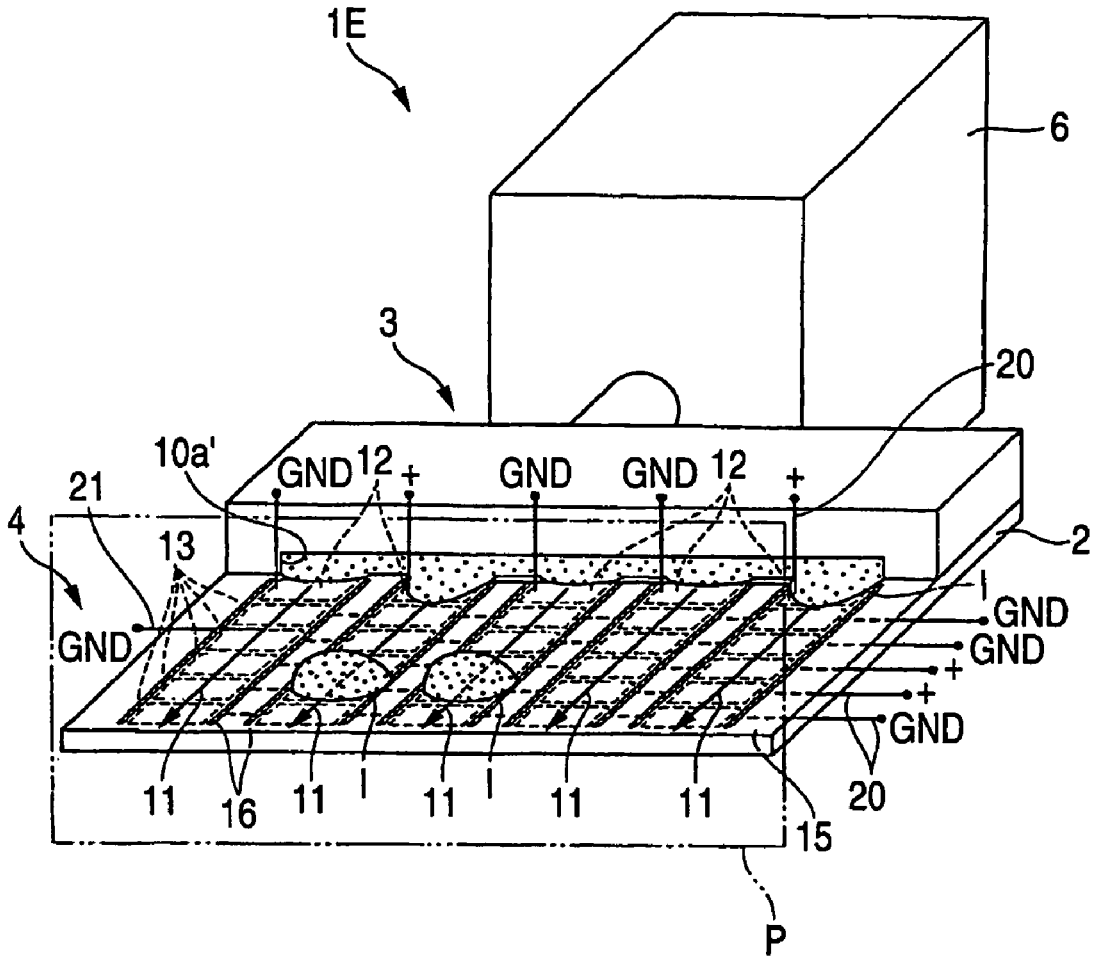
FIG. 22 is a schematic perspective view illustrating a printing apparatus according to a fifth modification of the embodiment.

8) As shown in FIG. 22, a printing apparatus 1E may have only one deriving port 10*a*'. A plurality of ink transfer path 11' may extend from the one common deriving port 10*a*'.

9) The aforementioned embodiment and the modifications thereof are examples of application of the invention to a printing apparatus adapted to transfer ink to the recording paper P. However, the invention can be applied to other various printing apparatuses, for instance, a printing apparatus in which predetermined patterning is performed on the substrate.

Also, the liquid to be transferred is not limited to ink and may be drug solution, living body solution, electrically conductive solution as wire material, organic EL resin and the like.

What is claimed is:

1. A printing apparatus comprising:

a substrate having a flat surface:

a common liquid chamber that stores electrically conductive liquid and has a plurality of deriving ports;

a plurality of liquid transfer paths extending from the common liquid chamber to a print medium, the plurality of liquid transfer paths provided on the flat surface of the substrate;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes, the plurality of second electrodes provided on the flat surface of the substrate;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

wherein the liquid transfer controlling unit controls the second voltage applying unit so that a voltage is sequentially applied to the plurality of second electrodes along the liquid transfer paths;

wherein the plurality of liquid transfer paths extend in parallel to a first direction; and the plurality of second electrodes provided on the plurality of liquid transfer paths are arranged in a second direction perpendicular to the first direction and are disposed on a plane in a matrix form; and wherein liquid repellency of areas between the plurality of liquid transfer paths remains unchanged as viewed in a direction perpendicular to the flat surface of the substrate such that liquid does not move on the areas over the liquid transfer path.

2. The printing apparatus according to claim 1, wherein in a state in which the first voltage applying unit applies no voltage to the first electrode, a part of the first insulating film, which is placed on a surface of the first electrode, has liquid repellency being higher than that of a liquid contact surface provided near to the deriving port, which adjoins the part of the first insulating film.

3. The printing apparatus according to claim 1, wherein the first electrodes and the second electrodes are formed on a same plane.

4. The printing apparatus according to claim 1, further comprising:

a third electrode held at a predetermined constant electric potential level and adapted to be in contact with the liquid transfer path.

5. The printing apparatus according to claim 4, wherein the first insulating film and the second insulating film are continuously formed over the first electrodes and the second electrodes; and the third electrode extends along the liquid transfer paths on surfaces of the insulating films continuously formed.

6. The printing apparatus according to claim 4, wherein the first insulating film and the second insulating film are continuously formed over the first electrodes and the second electrodes; and the third electrode is formed on a surface spaced apart from a plane on which the first insulating film and the second insulating film are formed.

7. The printing apparatus according to claim 1, wherein the plurality of second electrodes arranged in the second direction over the plurality of liquid transfer paths are electrically connected to one another; and the second voltage applying unit is configured to simultaneously apply a voltage to all the second electrodes arranged in the second direction.

8. The printing apparatus according to claim 1, wherein the second insulating film is provided astride the plurality of liquid transfer paths, and liquid repellency of areas of the second insulating film between the plurality of liquid transfer paths remains unchanged as viewed in the direction perpendicular to the flat surface of the substrate.

9. A printing apparatus comprising:

a common liquid chamber that stores electrically conductive liquid and has a deriving port;

a plurality of liquid transfer paths extending from the common liquid chamber to a print medium;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

the liquid transfer controlling unit controls the second voltage applying unit so that a voltage is sequentially applied to the plurality of second electrodes along the liquid transfer paths; and a third electrode held at a predetermined constant electric potential level and configured to be in contact with the liquid on the liquid transfer path;

wherein the first insulating film and the second insulating film are continuously formed over the first electrodes and the second electrodes; and the third electrode extends along the liquid transfer paths on surfaces of the insulating films continuously formed.

10. A printing apparatus comprising:

a common liquid chamber that stores electrically conductive liquid and has a deriving port;

a plurality of liquid transfer paths extending from the common liquid chamber to a print medium;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

the liquid transfer controlling unit controls the second voltage applying unit so that a voltage is sequentially applied to the plurality of second electrodes along the liquid transfer paths;

wherein the plurality of liquid transfer paths extend in parallel to a first direction; and the plurality of second electrodes provided on the plurality of liquid transfer paths are arranged in a second direction perpendicular to the first direction and are disposed on a plane in a matrix form, and wherein the second voltage applying unit is configured to be able to simultaneously apply a voltage to consecutively arranged ones of the plurality of second electrodes arranged in the first direction of each of the liquid transfer paths.

11. The printing apparatus according to claim 10, wherein the second voltage applying unit is configured to be able to simultaneously apply a voltage to at least all the second electrodes of one line among the second electrodes of plurality of lines arranged in the second direction over the liquid transfer paths.

12. A printing apparatus comprising:

a common liquid chamber that stores electrically conductive liquid and has a deriving port;

a plurality of liquid transfer paths extending from the common liquid chamber to a print medium;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

the liquid transfer controlling unit controls the second voltage applying unit so that a voltage is sequentially applied to the plurality of second electrodes along the liquid transfer paths; and wherein the liquid transfer control unit comprises:

a liquid amount determining unit that determines an amount of liquid to be derived from the common liquid chamber to a predetermined one of the liquid transfer paths by the liquid deriving unit; and a voltage apply number determining unit that determines a total number of one of the first electrodes, which is provided on the predetermined liquid transfer path, and one or more of the second electrodes arranged from the one of the first electrodes and configured so that a voltage is simultaneously applied to the one of the first electrodes and to the one or more of the second electrodes.

13. The printing apparatus according to claim 12, wherein the liquid transfer controlling unit comprises:

a voltage apply electrode determining unit that determines electrodes, to which a voltage is applied, and for sequentially selecting the second electrodes arranged on the predetermined liquid transfer path so that the number of the second electrodes, to which a voltage is simultaneously applied, is equal to the total number.

14. A printing apparatus comprising;

a common liquid chamber that stores electrically conductive liquid and has a deriving port;

a plurality of liquid transfer paths extending from the common liquid chamber to a print medium;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

the liquid transfer controlling unit controls the second voltage applying unit so that a voltage is sequentially applied to the plurality of second electrodes along the liquid transfer paths; and wherein the liquid transfer control unit comprises:

a liquid amount determining unit that determines an amount of liquid to be derived by the liquid driving unit from the common liquid chamber to a predetermined one of the liquid transfer path; and a voltage apply time determining unit that determines a voltage application time, during which the first voltage applying unit applies a voltage to the first electrodes, according to the amount of liquid, which is determined by the liquid amount determining unit.

15. A printing apparatus comprising:

a common liquid chamber that stores electrically conductive liquid and has a deriving port;

a plurality of liquid transfer paths extending from the common liquid chamber to a print medium;

a liquid deriving unit that selectively derives liquid from the common liquid chamber to the plurality of liquid transfer paths, the liquid deriving unit comprising:

a plurality of first electrodes, respectively provided near to the deriving port, corresponding to the plurality of liquid transfer paths;

a first voltage applying unit that selectively applies a voltage to the plurality of first electrodes; and a first insulating film provided on surfaces of the plurality of first electrodes and configured to reduce, when the first voltage applying unit applies a voltage to one of the first electrodes, liquid repellency of a part corresponding to the one of the first electrodes in comparison with liquid repellency of the part in a state in which no voltage is applied to the one of the first electrodes;

a liquid transfer unit that transfers the liquid, which is derived to the liquid transfer path, to the print medium; and a liquid transfer controlling unit that controls the liquid deriving unit and the liquid transfer unit;

wherein the liquid transfer unit comprises:

a plurality of second electrodes arranged along each of the liquid transfer paths from a corresponding one of the plurality of first electrodes;

a second voltage applying unit that selectively applies a voltage to the plurality of second electrodes; and a second insulating film provided on surfaces of the plurality of second electrodes and configured to reduce, when the second voltage applying unit applies a voltage to one of the second electrodes, liquid repellency of a part corresponding to the one of the second electrodes in comparison with liquid repellency of the part in a state in which no voltage is applied to the one of the second electrodes;

the liquid transfer controlling unit controls the second voltage applying unit so that a voltage is sequentially applied to the plurality of second electrodes along the liquid transfer paths; and wherein the liquid transfer control unit comprises:

a liquid amount determining unit that determines an amount of liquid, which is transferred by the liquid transfer unit to the print medium through the predetermined liquid transfer path; and liquid dividing unit that divides liquid on the predetermined second electrode by causing the second voltage applying unit to simultaneously apply a voltage to two of the second electrodes, which respectively adjoin the predetermined second electrode at an upstream side and a downstream side of the predetermined liquid transfer path, in a state in which the liquid is present at a part of the second insulating film corresponding to the predetermined second electrode in a case where the amount of liquid, which is determined by the liquid amount determining unit, is less than a predetermined amount.

* * * * *

UNITED STATES PATENT AND TRADEMARK OFFICE

CERTIFICATE OF CORRECTION

PATENT NO. : 7,641,322 B2
APPLICATION NO. : 11/167292
DATED : January 5, 2010
INVENTOR(S) : Hiroto Sugahara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 765 days.

Signed and Sealed this

Sixteenth Day of November, 2010

David J. Kappos

David J. Kappos
*Director of the United States Patent and Trademark Office*